US008362955B2

(12) United States Patent
Adams et al.

(10) Patent No.: US 8,362,955 B2
(45) Date of Patent: Jan. 29, 2013

(54) ANTENNA SYSTEM

(75) Inventors: David Adams, Chelmsford (GB); Peter Deane, Fitzroy Harbour (CA); Steven Hall, Harlow (GB)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/231,360

(22) Filed: Sep. 13, 2011

(65) Prior Publication Data

US 2012/0001801 A1 Jan. 5, 2012

Related U.S. Application Data

(63) Continuation of application No. 12/145,753, filed on Jun. 25, 2008, now Pat. No. 8,063,822.

(51) Int. Cl.
*H01Q 3/00* (2006.01)

(52) U.S. Cl. ..... 342/373; 342/368

(58) Field of Classification Search ..... 342/368, 342/372, 373, 377, 380, 382; 370/210, 328
See application file for complete search history.

(56) References Cited

U.S. PATENT DOCUMENTS

| | | | | |
|---|---|---|---|---|
| 4,849,764 | A * | 7/1989 | van Heyningen | 342/381 |
| 6,703,976 | B2 | 3/2004 | Jacomb-Hood | |
| 2006/0145919 | A1 | 7/2006 | Pleva | |
| 2010/0167653 | A1 * | 7/2010 | Kim et al. | 455/63.1 |
| 2010/0246377 | A1 * | 9/2010 | Zhang et al. | 370/210 |
| 2011/0280188 | A1 * | 11/2011 | Jeon et al. | 370/328 |
| 2012/0087304 | A1 * | 4/2012 | Porat et al. | 370/328 |

* cited by examiner

*Primary Examiner* — Dao Phan
(74) *Attorney, Agent, or Firm* — Meyertons, Hood, Kivlin, Kowert & Goetzel, P.C.

(57) ABSTRACT

A beamformer is arranged to receive an input from a first antenna element and from at least one other antenna element and to generate at least a first and second output beam. The first and second output beams are combined at a connecting port such that signals received at the first antenna element are constructively combined at the connecting port and signals received at another antenna element or elements are destructively combined at the connecting port, so that a receiver connected to the connecting port may receive signals from the first antenna element and may not receive signals from the other antenna element or elements. The arrangement may also be used to transmit a signal which is fed into the connecting point from the first antenna element and not from the other antenna element or elements.

28 Claims, 16 Drawing Sheets

Prior Art

ANTENNA SYSTEM

RELATED APPLICATION

This application is a continuation of U.S. patent application Ser. No. 12/145,753, filed Jun. 25, 2008, now U.S. Pat. No. 8,063,822.

FIELD OF THE INVENTION

The present invention relates generally to antennas for wireless data communications networks, and more specifically to beamforming antenna systems.

BACKGROUND OF THE INVENTION

Modern wireless communications systems place great demands on the antennas used to transmit and receive signals, especially at cellular wireless base stations. Antennas are required to produce a carefully tailored radiation pattern with a defined beamwidth in azimuth, so that, for example, the wireless cellular coverage area has a controlled overlap with the coverage area of other antennas.

In addition to a defined azimuth beam, such antennas are also required to produce a precisely defined beam pattern in elevation; in fact the elevation beam is generally required to be narrower than the width of the azimuth beam.

It is conventional to construct such antennas as an array of antenna elements so as to form the required beam patterns. Such arrays require a feed network to split signals for transmission into components with the correct phase relationship to drive the antenna elements; when receiving, the feed network doubles as a combiner.

An array consisting of a single vertical column of antenna elements is commonly used as a building block at cellular radio base stations. Such a column antenna can be designed to produce the required narrow elevation beam, and will typically be designed to give azimuth coverage of a sector in a cellular wireless network. In a simple configuration, three such column antennas are deployed at a base station to give coverage to three sectors; this is a form of a spatial division multiple access (SDMA) system, in which the capacity of a cellular wireless system is enhanced by enabling a given frequency band to be used substantially independently by wireless links which are spatially separated.

FIG. 1 illustrates a conventional tri-cellular deployment of base stations. A number of cell sites 1*a* . . . 1*g* are deployed to give wireless coverage over a given area. It can be seen that there are three radiation beams roughly equally spaced in azimuth angle at each cell site (for example, in the case of cell site 1*a*, there are three radiation beams 3*a*, 3*b*, 3*c*). Further capacity increases can be achieved by sub-dividing the azimuth plane more finely in angle, for example to form a hex-sectored plane, as shown in FIG. 2 (in the case of cell site 1*a* there are six hex-sector radiation beams 5*a* . . . 5*f*).

The required azimuth beam patterns for a system such as that illustrated by FIG. 2 can be implemented by the use of multiple column antennas in combination with a beamformer. The beamformer couples together the column antennas in the appropriate amplitude and phase relationship to give the required beam patterns. Such a beamformer will typically be a passive device that may be used for both transmission and reception of signals. Typically, in such a system, the column antennas are referred to as azimuth antenna elements or simply antenna elements.

FIG. 3 illustrates a system in which four azimuth antenna elements 7*a* . . . 7*d* are combined to give two beam outputs at ports 11*a*, 11*d* for a case in which two beams are required per sector. Each beam may be connected to a respective radio transceiver 27*a*, 27*b*, which will typically be connected to a telecommunications network 29 such as the public switched telecommunications network (PSTN). It is known, as shown by FIG. 4, to implement the beamformer 8 by the use of a Butler Matrix 14. The beamformer 8 has 4 antenna element ports 9*a* . . . 9*d*, typically connected to an array of antenna elements (as illustrated in FIG. 3 and indicated by reference numerals 7*a* . . . 7*d*). It is known to combine pairs of beam ports of the Butler Matrix 20*a*, 20*c* and 20*b*, 20*d* using 3 dB hybrid couplers 13*a*, 13*b* and phase shifters 16*a*, 16*b* to produce two beams at beam ports 11*a*, 11*d*. However, a beamformer as illustrated by FIGS. 3 and 4 suffers from complexity, involving the use of 6 hybrid couplers and four phase shifters. It should be noted that a beamformer as illustrated by FIGS. 3 and 4 forms beams by combining the contributions from each of the antenna element ports 9*a* . . . 9*d* in such a way that signals from an antenna element port cannot be constructively combined at a beam port while signals from another antenna element port are destructively combined at that beam port. Accordingly, it is not possible to access at a beam port the signals received by an antenna element but not those from another antenna element.

It may be convenient to locate the beamformer 8 close to the antenna elements 7*a* . . . 7*d*, which will typically be located on an antenna tower. It may also be advantageous in terms of cost, size and performance to integrate the beamformer with the antenna elements, contained within the same enclosure.

However, the integration of a beamformer with its associated antenna elements may present disadvantages in terms of potential upgrade strategies if such strategies require access to the individual antenna elements. In order to access the individual antenna elements, an operator would require to climb the tower and modify or replace the beamformer; in the case of an integrated system this may not be possible, necessitating the replacement of the integrated unit 6. The replacement and re-alignment of antenna elements may be costly; accordingly the lack of an economical upgrade path may limit the deployment of an otherwise attractive integrated beamformer and antenna system.

It is an object of the present invention to provide methods and apparatus which addresses these disadvantages.

SUMMARY OF THE INVENTION

In accordance with aspects of the present invention, there is provided methods and systems according to the appended claims.

More specifically, in one aspect there is provided a method of receiving signals from a first antenna element, said first antenna element providing input to a beamformer, the beamformer being arranged to receive input from at least one other antenna element and being arranged to generate at least two beams as output therefrom, the method comprising the steps of:

combining said at least two beam outputs at a connecting port such that said signals from said first antenna element are constructively combined at the connecting port; and combining said at least two beam outputs at the connecting port such that signals from antenna elements other than the first antenna element providing input to the beamformer are destructively combined at the connecting port; and configuring the connecting port so as to provide access to individual said signals received by said antenna elements.

The connecting port provides access to signals at an individual antenna element without the need to remove the beamformer, which may for example be beneficial in situations where access to the beamformer is difficult or costly or where the beamformer is physically integrated with the antenna elements.

Constructively combining signals is a process of combining signals substantially in phase so that the magnitude of the resultant signal is maximised. Destructively combining signals is a process of combining signals in such a way that they cancel, so that the magnitude of the resultant signal is minimised.

Preferably, the beams formed by the beamformer are orthogonal beams. The benefit of forming orthogonal beams is that the signal loss between the antenna element and the connecting point is minimised.

In one arrangement the beamformer can be arranged to form three output beams from a combination of input from three antenna elements, at least one of the antenna elements being said first antenna element, the method further comprising combining said three output beams at the connecting port. In such an arrangement the beamformer can be configured according to the following steps, so as to achieve the aforementioned constructive and destructive combining of signals at the connecting port:

combining signals received by the first antenna element with signals received by a third of said three antenna elements, in which combining comprises in-phase combining, to provide a third output beam;

combining signals received by the first antenna element with signals received by the third antenna element, in which said combining comprises anti-phase combining, so as to provide a first intermediate signal;

combining signals received by a second of the three antenna elements with the first intermediate signal such that the intermediate signal is at minus ninety degrees phase to the signals received by the second antenna element, so as to provide the first output beam; and combining signals received by the second antenna element with the first intermediate signal such that the intermediate signal is at ninety degrees phase to the signals received by the second antenna element, to provide the second output beam.

In a yet further arrangement, the beamformer can be arranged to form four output beams from a combination of input from four antenna elements, at least one of the antenna elements being the first antenna element, the method further comprising combining the four output beams at the connecting port.

Conveniently, a further beamformer can be used to combine the beams output from the beamformer. The further beamformer may be connected as an inverse beamformer, that is to say the input beam ports of the further beamformer are connected to the output beam ports of the beamformer, in which case an individual input port of the further beamformer provides the connecting port. The benefit of using a further beamformer is that a similar technology may be employed to that used to implement the beamformer, thereby potentially giving cost savings in design and construction.

Preferably, the further beamformer provides a further connecting port, thereby ensuring that a radio system that requires access to more than one individual antenna element may be provided with such access via a suitable further connecting port. Examples of such radio systems are multiple in multiple out (MIMO) systems, diversity combination and adaptive beamforming systems.

Conveniently the connecting port, or in the case of arrangements that include the further beamformer, the further connecting port will be connected to a receiver.

Advantageously, the further beamformer may be implemented by an array of weighting elements, which weight, in amplitude and phase, the beam outputs from the beamformer and combine the weighted components at a connecting port. The advantage of implementing the further beamformer by an array of weighting elements is that the implementation may be economical, for example the weighting elements and combination may be implemented in digital signal processing.

The beamformer arrangement can also be arranged to transmit signals from antenna elements; in one arrangement, this involves transmitting signals from a first antenna element, said first antenna element receiving input from a beamformer, the beamformer being arranged to input signals to at least one other antenna element and comprising a set of beam ports for receiving signals to be transmitted via said antenna elements, the set of beam ports being connected to a connecting port external to said beamformer, the method comprising:

coupling signals to said beam ports of the beamformer such that signals received at the connecting port are constructively combined at said first antenna element; and coupling signals to said beam ports such that signals received at the connecting port are destructively combined at antenna elements other than said first antenna element, thereby enabling a transmitter connected to said connecting port to transmit from said first antenna element and not to transmit from the other antenna elements.

Further features and advantages of the invention will become apparent from the following description of preferred embodiments of the invention, given by way of example only, which is made with reference to the accompanying drawings.

DETAILED DESCRIPTION OF THE INVENTION

In general, the present invention is directed to methods and apparatus that enhance the capacity of wireless communications between a base station and remote stations. The invention will be described in the context of a cellular wireless system, but it is to be understood that this example is chosen for illustration only and that other applications of the invention are possible.

Figure 5:
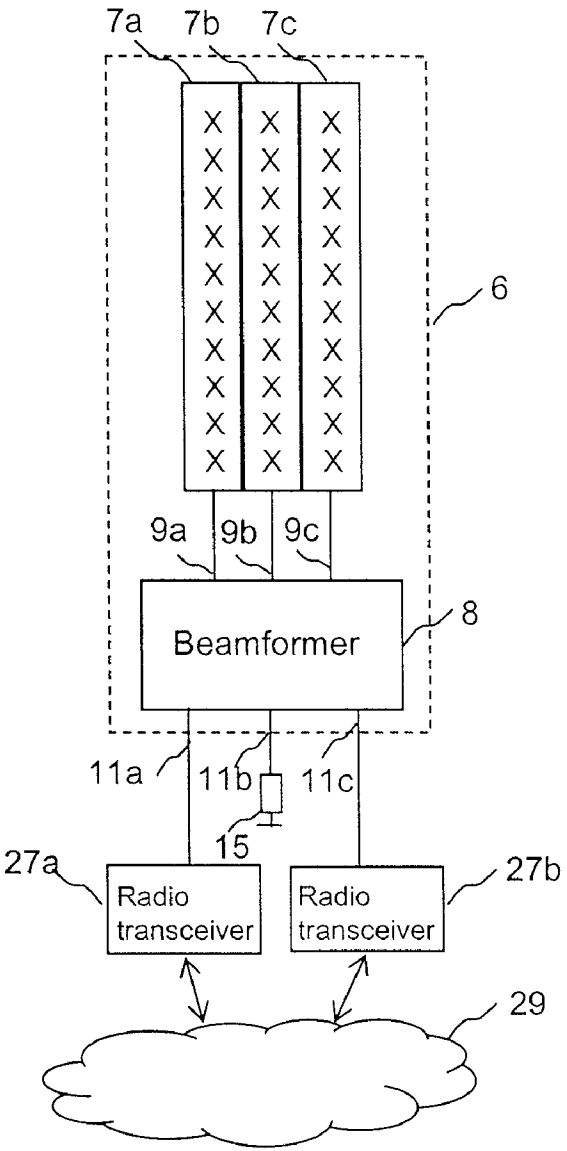
FIG. 5 is a schematic diagram showing a three column beamformer providing two output beams according to an embodiment of the invention.

FIG. 5 illustrates a first embodiment of the invention, which relates to a beamformer that produces two beams from a three element antenna array. Three antenna elements 7*a*, 7*b* and 7*c*, which may be typically vertical columns of antenna elements, are connected to beamformer 8, which may typically be integrated with the antenna elements and may be within the same enclosure. In a one deployment, the antenna elements 7*a*, 7*b*, and 7*c* and beamformer 8 will be sited on a tower at a cellular radio cell site. Three such integrated units would be deployed at a cell site, so that each may give coverage to an approximately 120 degree sector. Other arrangements are of course possible: indeed there is no inherent requirement for the coverage of a respective unit to be 120 degrees. As shown in the Figure, three outputs are provided from the beamformer 8, but only two of the beam ports 11*a*, 11*c* are connected to a respective radio transceiver 27*a*, 27*b*. The radio transceivers may be integrated into a cellular radio base station, and are typically used to enable the capacity of the cellular system to be increased by the simultaneous use of the same radio resource in terms of frequency and time within the area of coverage provided by the two beams generated by the beamformer 8. As per the prior art arrangements described above, the radio transceivers can be connected to a telecommunications network such as the public switched telecommunications network (PSTN) 29.

Figure 4:
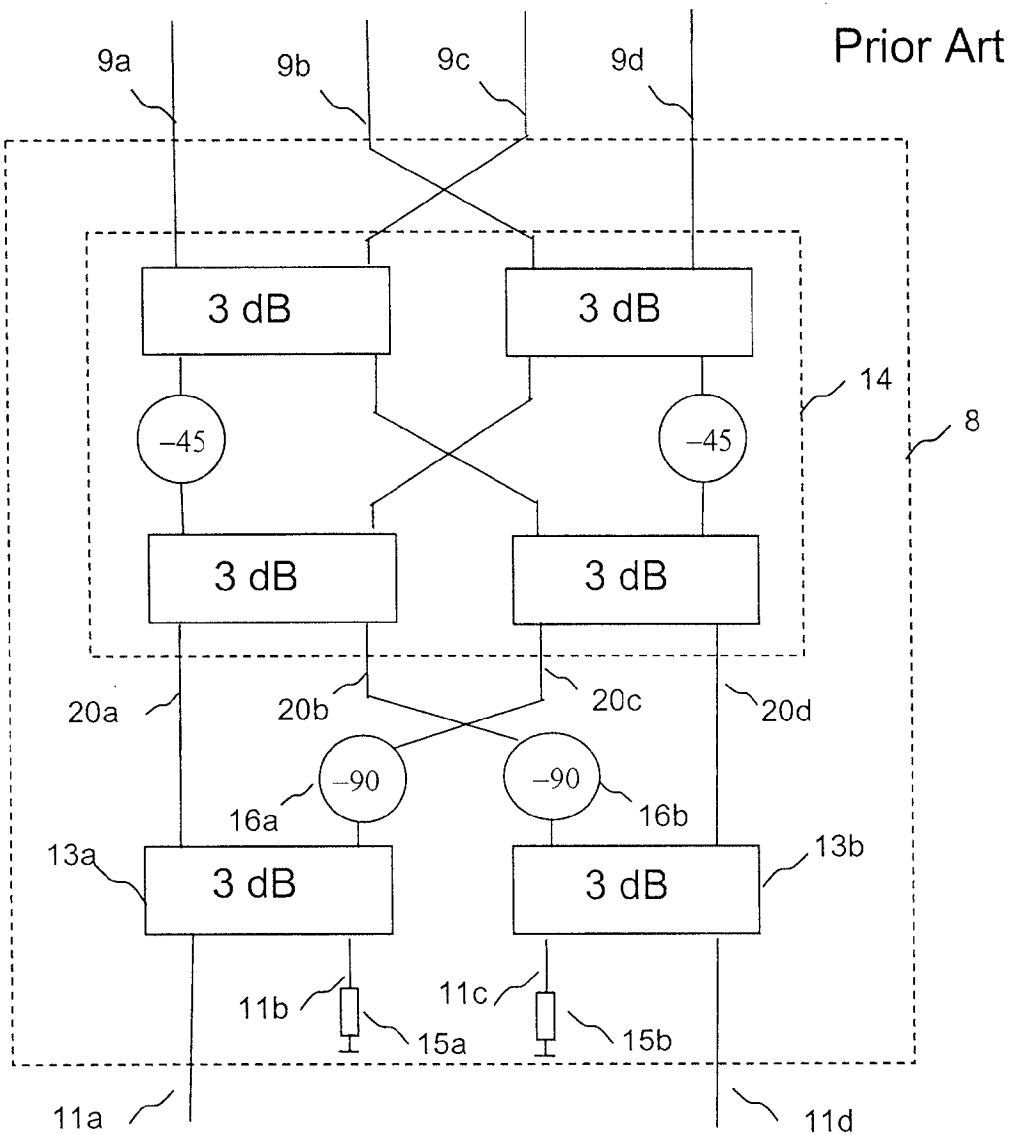
FIG. 4 is a schematic diagram showing a conventional beamformer utilising a Butler Matrix and combined beam ports.

Typically, the internal structure of the beamformer will produce the same number of beams as there are antenna element ports; if fewer beams are required for use, then the unwanted beam ports (11*b*) may be simply terminated with an appropriately matched impedance. Conventionally unwanted beam ports are terminated internally to the beamformer, as illustrated in FIG. 4 by the terminations 15*a* and 15*b* which are connected to the unwanted ports 11*b* and 11*c*, since there is no need to have external access to them and the provision of external connectors would add unnecessary cost. However, in the embodiment of the invention illustrated in FIG. 5, the third beam port 11*b* is preferably provided with a connector external to the enclosure 6, so that the port may be simply terminated with an appropriate impedance for initial deployment, while enabling future upgrade options as will be discussed with reference to later figures.

It should be noted that the system shown in FIG. 5 shows only one polarisation channel; typically the system would be duplicated in parallel using antenna elements of an orthogonal polarisation. There is thus the capability to provide a two-branch MIMO system, using the two orthogonal polarisation channels. That is to say there are two transceivers at the base station on orthogonal polarisations and preferably two transceivers at a remote unit; the two transceivers would be used to enable orthogonal data paths to provide extra payload capacity. However, with the system as shown in FIG. 5, it is not possible to provide more than two MIMO transceivers at a base station.

Figure 6:
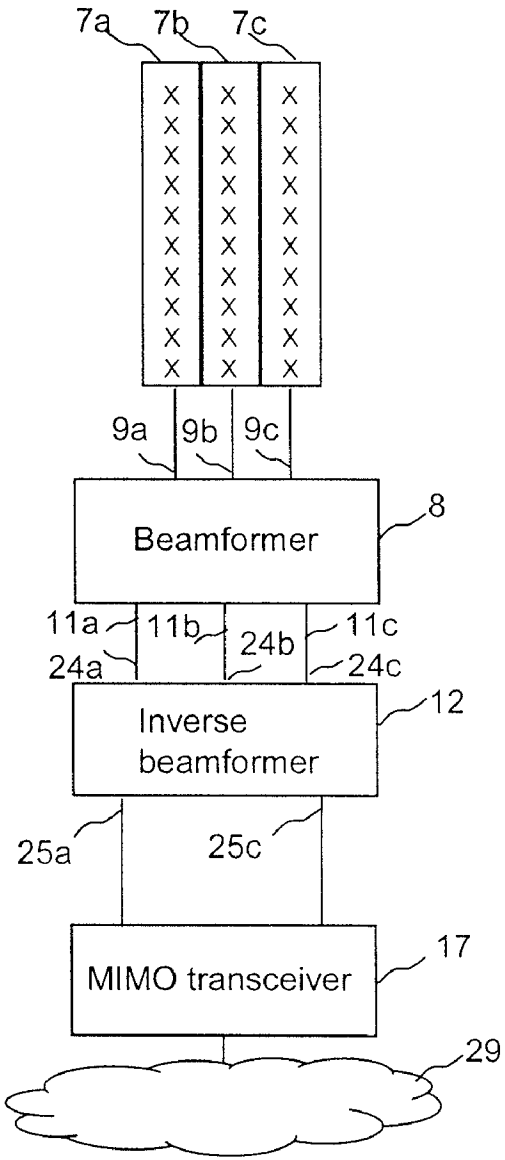
FIG. 6 is a schematic diagram showing an embodiment of the invention in a MIMO system.

FIG. 6 illustrates the use of the beamformer 8 of FIG. 5 in a MIMO radio system that provides two branches per polarisation per sector. Whilst for 2-branch MIMO transceivers the polarisations relating to one column of elements would typically be used, FIG. 6 shows use of two end columns, each of which has a common polarisation associated therewith; such an arrangement is depicted for the purposes of exemplifying an embodiment of the invention. The arrangement additionally includes an inverse beamformer 12 connected to the beam ports 11*a*, 11*b* and 11*c* of the beamformer 8. In this arrangement the beam port 11*b* of beamformer 8 that was terminated in the system of FIG. 5 has its termination removed and is connected to the inverse beamformer. The inverse beamformer 12 receives the beams formed by the beamformer 8 and transforms them to signals that are output via individual element ports 25*a*, 25*c*. Individual element ports may also be referred to as connecting ports, or connection points.

On receive, the system operates as follows: signals are received by antenna elements 7*a* . . . 7*c* and transformed to beams that are output via beam ports 11*a*, 11*b*, 11*c*, at the output of the beamformer 8, each beam corresponding to a radiation pattern received by the antenna array 7*a* . . . 7*c*. The beam outputs are then transformed by the inverse beamformer 12 to represent the signals originally received by the antenna elements 7*a* . . . 7*c*. In the case of the system of FIG. 6, two outputs 25*a*, 25*c* of the inverse beamformer 12 are made available externally, carrying signals corresponding to the signals received by two of the antenna elements. In the case illustrated, the two outputs correspond to the end elements 7*a* and 7*c* of the array. The output of the inverse beamformer that is not made available externally may be terminated internally. It should be noted that the relative phases of the signals at the output of the inverse beamformer 12 may not be the same as the relative phases of the signals received by the antenna elements 7*a*, 7*b*, 7*c*.

For many applications (such as MIMO) the relative phase of the signals on these outputs is not important; however, if the relative phases on the individual element ports are required to correspond with the relative phases of the signals at the antenna array, then this can be achieved by the addition of phase shifting elements in line with the individual element ports 25*a*, 25*c*. The system has the characteristic that signals received by an individual antenna element 7*a* are connected to a respective individual element output of the inverse beamformer 25*a*, whereas signal received by the other elements 7*b*, 7*c* in the array are not connected to that individual element output 25*a*. The combination of the beamformer 8 and the inverse beamformer 12 thus in effect gives access to signals received by the antenna elements 7*a* . . . 7*c* without the need to remove the beamformer 8 from the system. This is particularly advantageous in arrangements where the beamformer 8 and the antenna elements 7*a* . . . 7*c* are integrated into a unit such that removal of the beamformer unit may not be feasible.

On transmit, the system operates in the reverse manner of the operation on receive. Signals connected to individual element ports 25*a*, 25*c* are transformed to give inputs to the beam ports 11*a* . . . 11*c* of the beamformer 8 such that the outputs of the beamformer to antenna elements 7*a* . . . 7*c* correspond to the signals input to the respective individual element ports 25*a*, 25*c*. That is to say that a signal input to an individual element port 25*a* of the inverse beamformer will be transmitted from the respective antenna element 7*a* and not from the other antenna elements 7*b*, 7*c*. As in the case of receive, the relative phase of the signals transmitted from the antenna elements may not be the same as the relative phases between the signals connected to the respective individual elements ports of the inverse beamformer. If the relative phases on the individual element ports are required to correspond with the relative phases of the signals at the antenna array, then this can be achieved by the addition of phase shifting elements in line with the individual element ports 25*a*, 25*c* as was mentioned for the case of receive.

Figure 7:
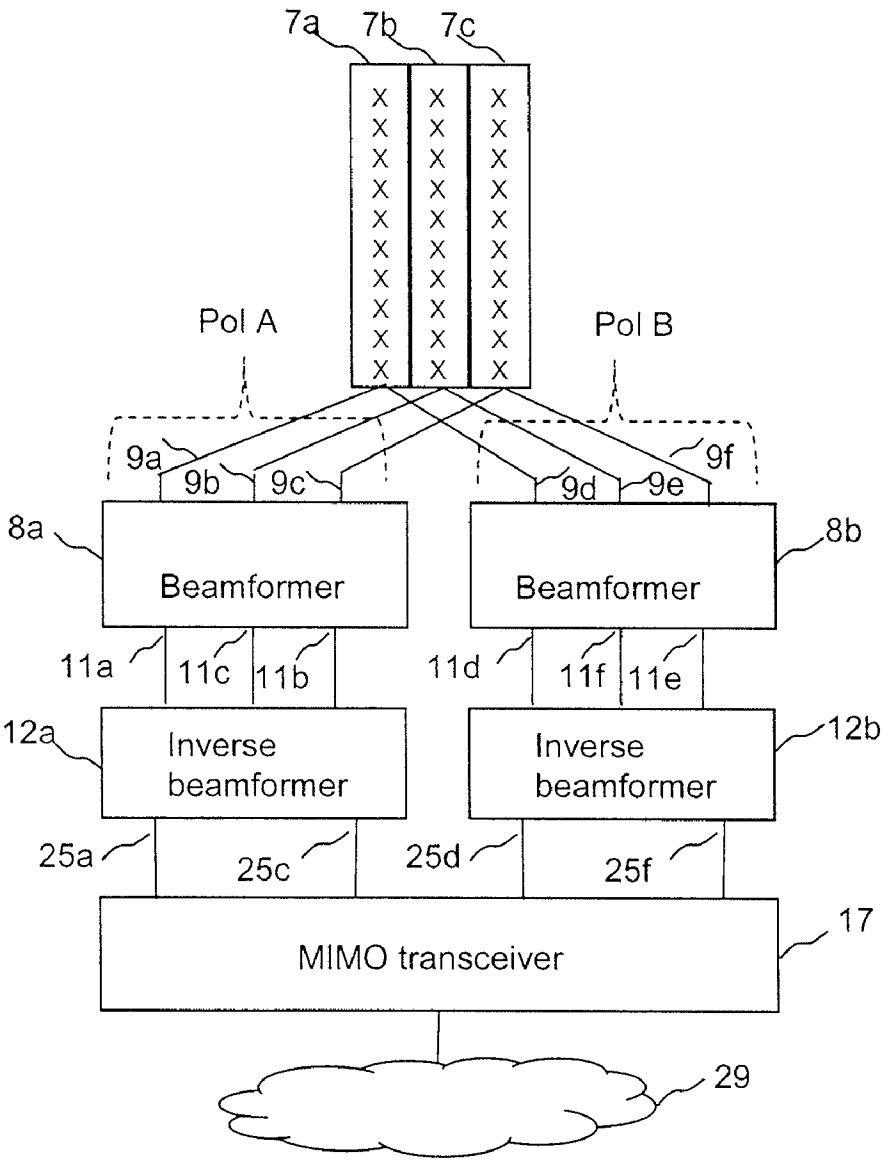
FIG. 7 is a schematic diagram showing an embodiment of the invention in a four-branch MIMO system.

FIG. 7 shows how the system of FIG. 6 may be applied to a system receiving orthogonal polarisations A and B to provide a MIMO system with four branches, that is to say potentially four orthogonal signal paths. Signals received by the antenna elements 7*a* . . . 7*c* on polarisation A are connected to the antenna ports of a beamformer 8*a* and signals received by the antenna elements 7*a* . . . 7*c* on polarisation B are connected to the antenna ports of a second beamformer 8*b*. Examples of orthogonal states of polarisations include pairs of linear states such as nominally vertical and horizontal, or nominally +/−45 degrees, and pairs of circular states such as left and right hand polarisation. Similar to the system of FIG. 6, the beamformer transforms an array of antenna element signals at each polarisation to an array of beams at the respective polarisation, and the array of beams at the respective polarisations are transformed by the inverse beamformers to an array of individual element signals at the respective polarisations. In the system illustrated in FIG. 7, it can be seen that four ports 25*a*, 25*c*, 25*d*, 25*f* are available to a MIMO transceiver 17, corresponding to polarisation A and polarisation B on each of two antenna elements 7*a* . . . 7*c*. As a variant, all or a sub-set of the individual element ports on one or both polarisations could be used to provide a port for a MIMO transceiver 17.

Figure 8:
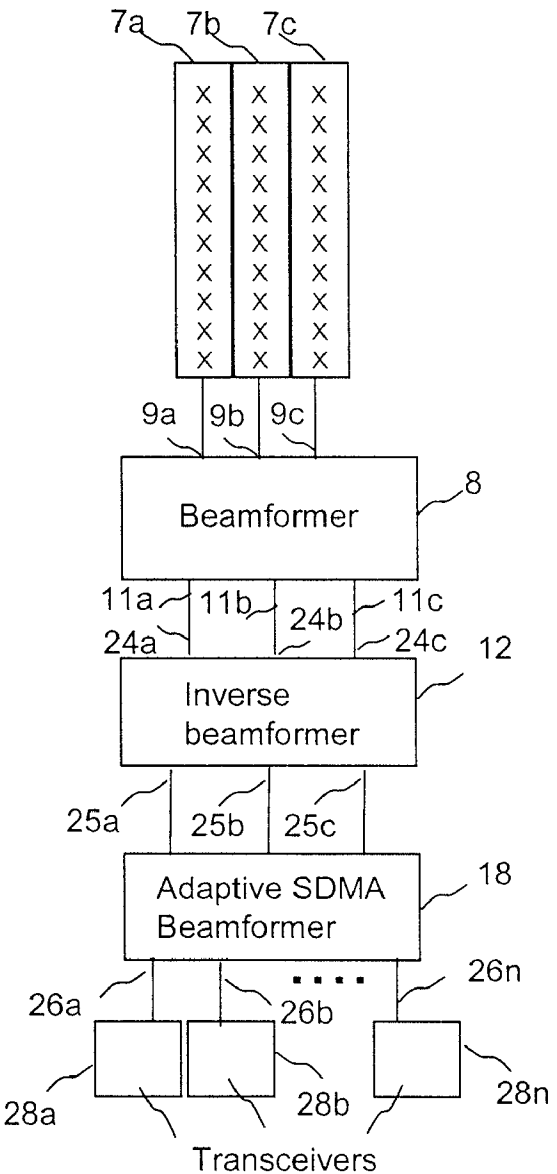
FIG. 8 is a schematic diagram showing an embodiment of the invention in an adaptive SDMA system.

FIG. 8 shows an embodiment of the invention in which a beamformer 8 and an inverse beamformer 12 are used in conjunction with an adaptive SDMA beamformer 18 connected to transceivers 28*a* . . . 28*n*. As in the example of FIG. 6, the inverse beamformer provides individual element ports corresponding to the signals on the antenna elements 7*a* . . . 7*c*. The adaptive SDMA beamformer 18 functions in a conventional manner so as to weight each individual element signal in amplitude and phase, where the weighting may be typically applied in Cartesian format as Inphase and Quadrature components, in order to form appropriate beams to provide coverage enabling base station transceivers 28*a* . . . 28*n* to communicate with respective transceivers. The transceivers may be user equipment, sharing between beams the same radio resource in terms of frequency and time. Typically, the function of the inverse beamformer 12 and the adaptive SDMA beamformer 18 may be implemented using digital signal processing.

FIGS. 9 to 12 illustrate the operation of a four port hybrid coupler, two of which are shown in FIG. 4 as parts 13*a*, 13*b* and which may also be simply referred to as a four port coupler, and which is also commonly referred to as a 3 dB coupler or a 90 degree hybrid coupler. Typically, the coupler may be constructed from two parallel coupled transmission lines, but other constructions of the coupler are well known in the art. As is known in the art, a four port coupler can be used in beamformers and inverse beamformers to combine signals, and in particular enable signals input thereto to be combined in a configurable manner.

The operation of a four port hybrid coupler comprising two pairs of ports according to an embodiment of the invention will now be described; referring to FIG. 9, ports A and B form a first pair and ports C and D form a second pair. The principle of operation is that signals applied to a port A of the first pair are split equally in power between two other ports, B, C, one from each pair, and none of the signals from this port A are transmitted to a fourth port D (this being the remaining port of the first pair). Thus signals received by a given port A of a pair of ports are output, equally in power, via the other port B of the pair and via a port C of another pair of ports.

The signals on the two ports B, C between which the power is split differ in phase by 90 degrees; the port C which is unpaired with the input port A carries signals with a −90 degree phase difference to those received by the paired port B. In the convention adopted in FIG. 9, the two ports B, C from which power is output are shown on the opposite side of the coupler 13 from the input A, but this may not correspond with the physical arrangement in a physical device.

Figure 9:
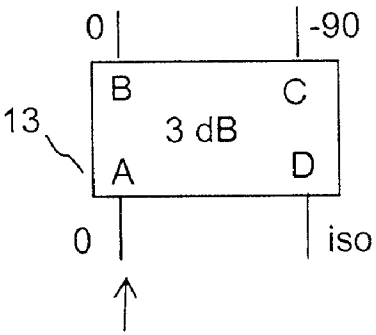
FIG. 9 is a schematic diagram showing operation of a four port coupler with an input to port A.
Figure 10:
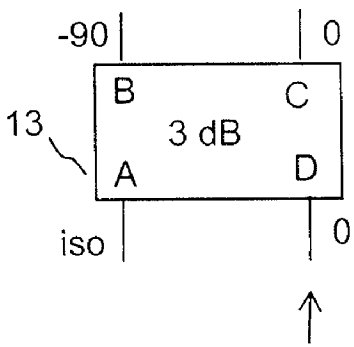
FIG. 10 is a schematic diagram showing operation of a four port coupler with an input to port D.
Figure 11:
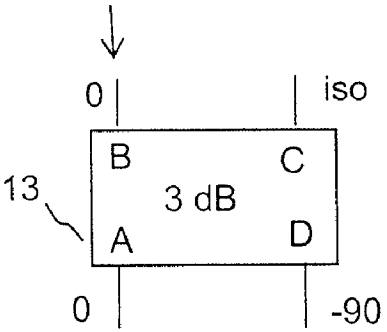
FIG. 11 is a schematic diagram showing operation of a four port coupler with an input to port B.
Figure 12:
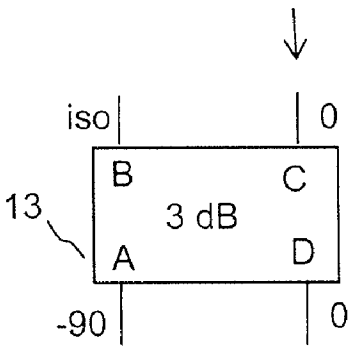
FIG. 12 is a schematic diagram showing operation of a four port coupler with an input to port C.

FIGS. 10, 11 and 12 illustrate the operation of the four port coupler of FIG. 9 when signals are input to each of the other three ports B, C, D. The principle of operation as outlined above applies, so that in FIG. 10 signals are applied to port D, and are split between ports C and B with signals at port B being at −90 degrees to those on port C. No signals are transmitted to port A. FIG. 11 illustrates the case in which signals are input to port B, and are split between ports A and D with signals at port D being at −90 degrees to those on port A. No signals are transmitted to port C. In FIG. 12 signals are input to port C, and are split between ports A and D with signals at port A being at −90 degrees to those on port D, while no signals are transmitted to port B. It should be understood that the operation as described assumes that coupler ports are matched to an appropriate terminating impedance.

If the four port coupler 13 is used as a combiner, then signals present on each output of the coupler may be obtained by vector addition; if signals that are 180 degrees out of phase with each other but that are otherwise identical arrive at a given output port, then the signals will cancel so that the port appears isolated. Accordingly the signal power will be transmitted to another port at which the signals do not cancel.

Figure 13:
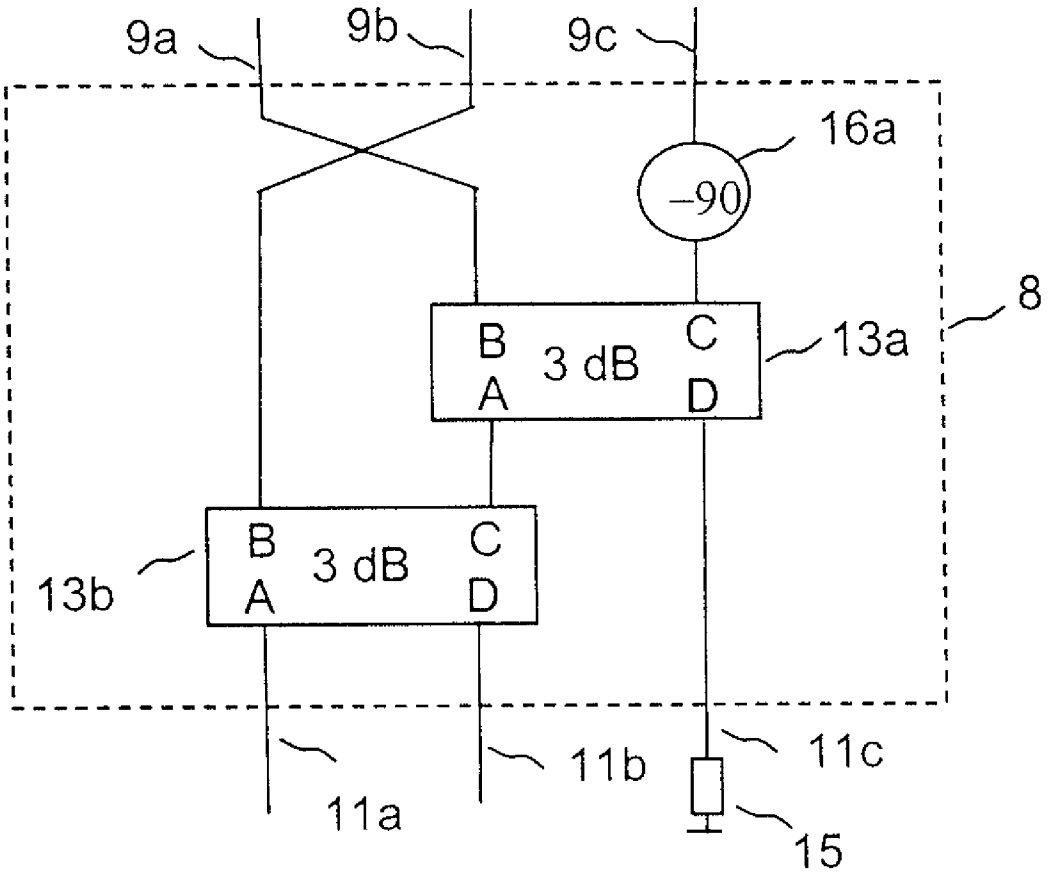
FIG. 13 is a schematic diagram showing a beamformer according to an embodiment of the invention.

FIG. 13 shows a three element beamformer 8 according to an embodiment of the invention. The beamformer 8 uses two four port couplers 13*a*, 13*b* and a −90 degree phase shifter 16*a*. The −90 degree phase shifter 16*a* may, for example, be implemented by a physical delay such as a length of printed track. It can be seen that in comparison with the conventional four element beamformer design of FIG. 4, the three element beamformer 8 of FIG. 13 involves fewer components and is therefore potentially smaller and cheaper to implement. In addition, since the addition of any single component introduces a loss of signal due to non-ideal implementation, a system with fewer components is advantageous since it can help reduce signal loss. It is important to minimise signal loss in a beamformer design, since, on receive, any loss of signal before the first amplifier stage impacts the signal to noise ratio of the system and on transmission any loss of signal is wasteful of expensive amplifier resource.

The operation of the beamformer 8 of FIG. 13 will now be described in operation for transmission of signals (it will be appreciated that the beamformer 8 is bi-directional and so can also be used for receive and indeed for both receive and transmission). The beamformer 8 has three beam ports 11*a*, 11*b* and 11*c*. In an application such as that illustrated by FIG. 5 requiring the formation of only two beams, the third beam output as indicated by reference numeral 11*c* may be terminated by an appropriate impedance 15.

The flow of signals from the first beam port as indicated by reference numeral 11*a* will now be described.

Signals entering at an amplitude of 1 into port A of the second four port coupler 13*b* are split into a component designated as a reference phase of 0 degrees at port B and a component at −90 degree phase at port C. The signal is split equally in power, that is to say the amplitude of each is half of the square root of two. Signals from port B of the second four port coupler 13*b* are connected to the second antenna element port 9*b*, and have an amplitude of half of the square root of two and at a phase of 0 degrees. Signals from port C of the second four port coupler 13*b* are connected to port A of the first four port coupler 13*a* and have an amplitude of half of the square root of two and a phase of −90 degrees. The signals leave port B of the first four port coupler 13*a* and have an amplitude of one half and a phase of −90 degrees; these signals are connected to the first antenna element port 9*a*. Signals leave port C of the first four port coupler 13*a* and have an amplitude of one half and a phase of −180 degrees; these signals are phase shifted by a further −90 degrees by the phase shifter 16*a* and are then connected to the third antenna element port 9*c*, at an amplitude of one half and a relative phase of −270 degrees, that is to say equivalent to +90 degrees relative to signals entering port A of the first four-port coupler 13*a*.

As a result, the antenna array 7*a* . . . 7*c* to which the antenna ports 9*a* . . . 9*c* are connected is excited as follows: the phase on signals on the first 7*a*, second 7*b* and third 7*c* antenna elements respectively is −90, 0, +90 degrees and the amplitude is 0.5, 0.707, 0.5 respectively. If the antenna elements 7*a* . . . 7*c* are half a wavelength apart in the azimuth plane at the frequency of operation of the antennas, then the excitation of the antenna elements results in a beam at −30 degrees from boresight (that is, closer in angle to the line from the centre of the array to the first element than to the line from the centre of the array to the third element), where boresight is an angle perpendicular in azimuth to the array 7*a* . . . 7*c*. On receive, signals will be received from a similar beam.

The flow of signals from the second beam port as indicated by reference numeral 11*b* will now be described.

Signals entering at an amplitude of 1 into port D of the second four port coupler 13*b* are split into a component designated as a reference phase of 0 degrees at port C and a component at −90 degree phase at port B. The signal is split equally in power, that is to say the amplitude of each is half of the square root of two. Signals from port B of the second four port coupler 13*b* are connected to the second antenna element port 9*b*, at an amplitude of half of the square root of two and at a phase of −90 degrees. Signals from port C of the second four port coupler 13*b* are connected to port A of the first four port coupler 13*a* with an amplitude of half of the square root of two and a phase of 0 degrees. The signals leave port B of the first four port coupler 13*a* with an amplitude of one half and a phase of 0 degrees; this signal is connected to the first antenna element port 9*a*. Signals leave port C of the first four port coupler 13*a* with an amplitude of one half and a phase of −90 degrees; this signal is phase shifted by a further −90 degrees by the phase shifter 16*a* and then connected to the third antenna element port 9*c*, at an amplitude of one half and a relative phase of −180 degrees.

As a result, the antenna array 7*a* . . . 7*c* is excited as follows: the phase on signals on the first 7*a*, second 7*b* and third 7*c* antenna elements respectively is 0, −90, −180 degrees and the amplitude is 0.5, 0.707, 0.5 respectively. If the antenna elements are half a wavelength apart in the azimuth plane at the frequency of operation of the antennas, then the excitation of the antenna elements results in a beam at 30 degrees from boresight. On receive, signals will be received from a similar beam.

Figure 1:
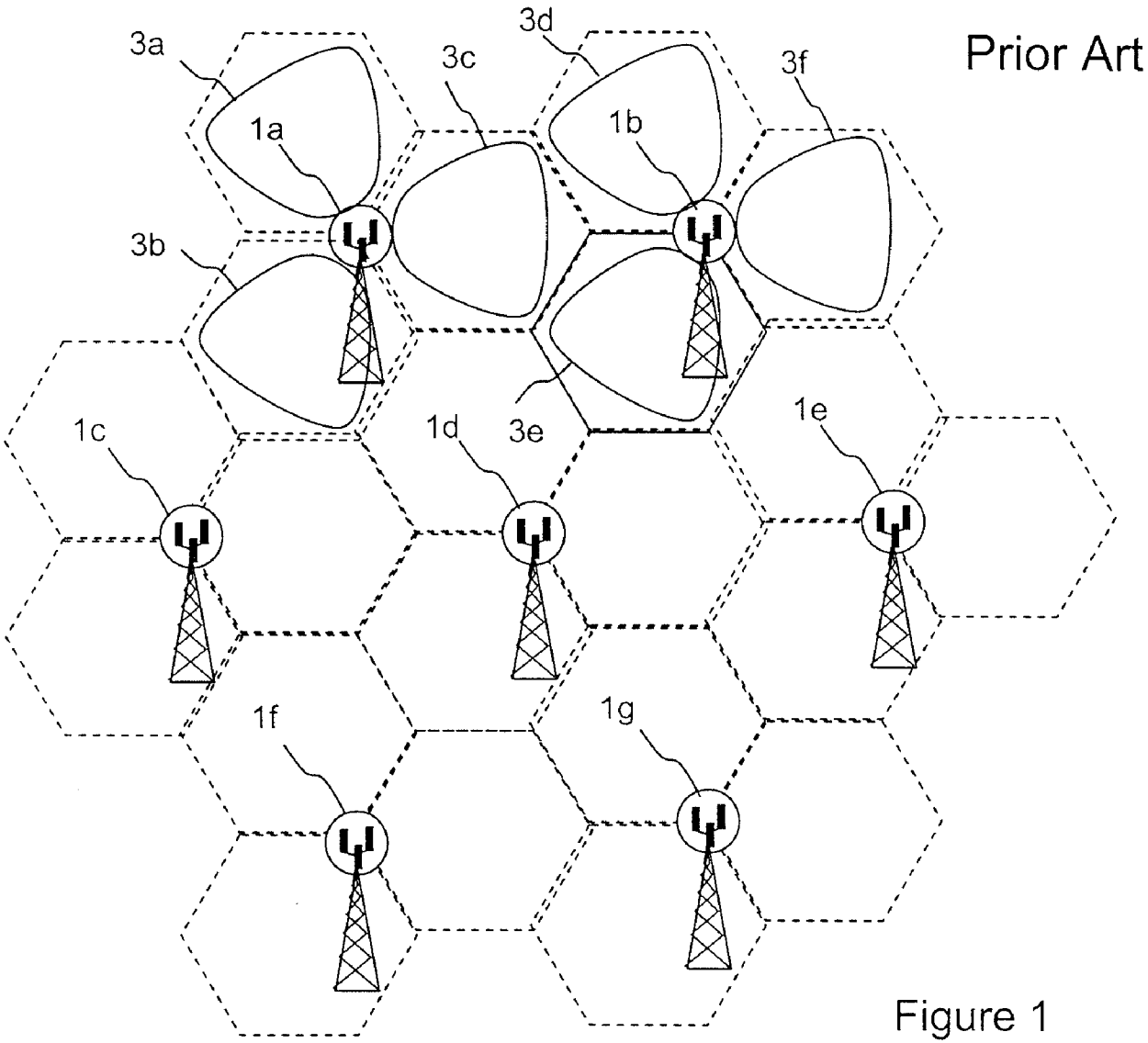
FIG. 1 is a schematic diagram showing a conventional tri-cellular cellular wireless deployment.
Figure 2:
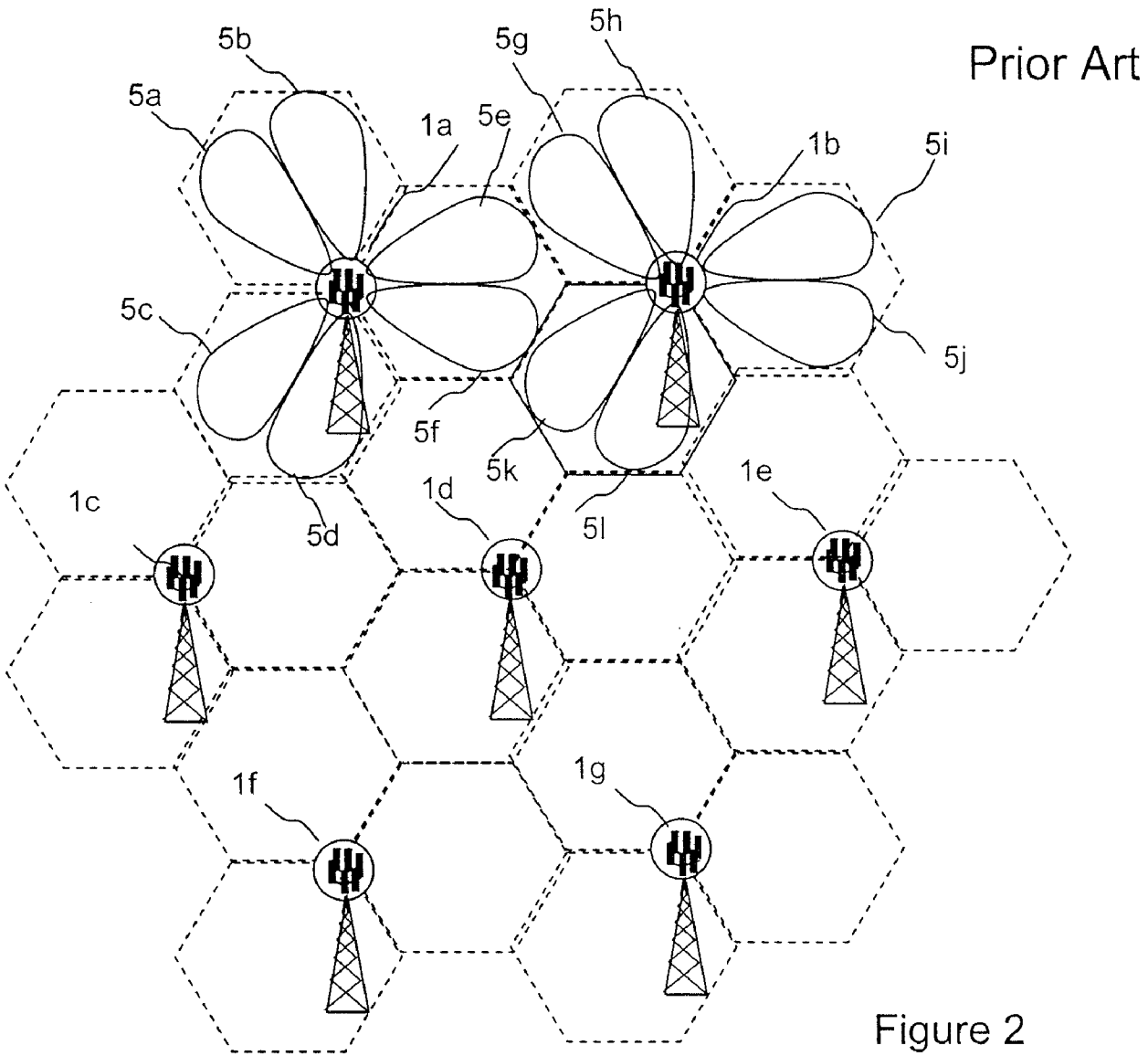
FIG. 2 is a schematic diagram showing a conventional hex-sectored cellular wireless deployment.

Hence it can be seen that the signals output via the first and second beam ports 11*a*, 11*b* form a pair of beams, one at −30 degrees and the other at +30 degrees to boresight. It will be appreciated that this pair of beams is well suited to give coverage within a 120 degree cellular base station sector such as in the system illustrated by FIG. 2; for example the two beams could provide beams 5*a*, 5*b* in FIG. 2.

The amplitude taper in the excitation across the array 7*a* . . . 7*c*, in which the centre element 7*b* has a higher amplitude than that of the end elements 7*a*, 7*c*, is beneficial in reducing sidelobe levels of the beams compared to the beam that would be formed if the elements were excited with equal amplitudes. Lower sidelobe levels in turn are beneficial in reducing interference between beams and therefore improving the capacity of a cellular wireless system.

It can be shown that the beams produced by the beamformer of FIG. 13 are orthogonal. Orthogonality of antenna beams is a well known concept in the art, and has the effect that a correlation between the beams across azimuth angles is zero. A result of the orthogonality of the beams is that the beamformer is ideally loss-less.

It should be noted that the amplitudes set out in the examples above are in arbitrary units and do not take account of implementation losses. Also, the phases quoted do not account for transmission delays through components and between components (except where specifically mentioned). A practical implementation would typically be laid out so that transmission paths are equalised in terms of delay from each beam port to each antenna port, as far as is possible. Techniques for the equalisation of transmission delays are well known in the art; for example, lengths of transmission line may be designed with the required delay characteristics.

The beamformer design need not necessarily be passive, as shown; instead, amplifiers may be inserted between stages if signal gain is required.

The third beam port 11*c* of the beamformer 8 illustrated by FIG. 13 produces a third beam, which can be shown to be orthogonal to the first and second beams. This beam has three lobes and so does not constitute a conventional beam that would be used for a cellular wireless system, since it is conventional to use beams with single lobes. In applications that require only two single lobe beams, such as that illustrated in FIG. 2, this third beam may be unused and the beam port 11*c* may simply be terminated with an appropriate impedance 15.

The flow of signals from the third beam port as indicated by reference numeral 11*c* will now be described.

Signals entering at an amplitude of 1 into port D of the first four port coupler 13*a* leave port B of the first four port coupler 13*a* with an amplitude of half of the square root of two and a phase of −90 degrees; this signal is connected to the first antenna element port 9*a*. Signals leave port C of the first four port coupler 13*a* with an amplitude of half of the square root of two and a phase of 0 degrees; this signal is phase shifted by a further −90 degrees by the phase shifter 16*a* and then connected to the third antenna element port 9*c*, at an amplitude of half of the square root of two and a relative phase of −90 degrees.

As a result, the antenna array 7*a* . . . 7*c* is excited as follows: the phase on signals on the first 7*a*, second 7*b* and third 7*c* antenna elements respectively is −90, no signal, −90 degrees and the amplitude is 0.707, 0, 0.707 respectively. If the antenna elements are half a wavelength apart in the azimuth plane at the frequency of operation of the antennas, then the excitation of the antenna elements results in a beam at boresight, with additional lobes either side of boresight. On receive, signals will be received from a similar beam.

Figure 14:
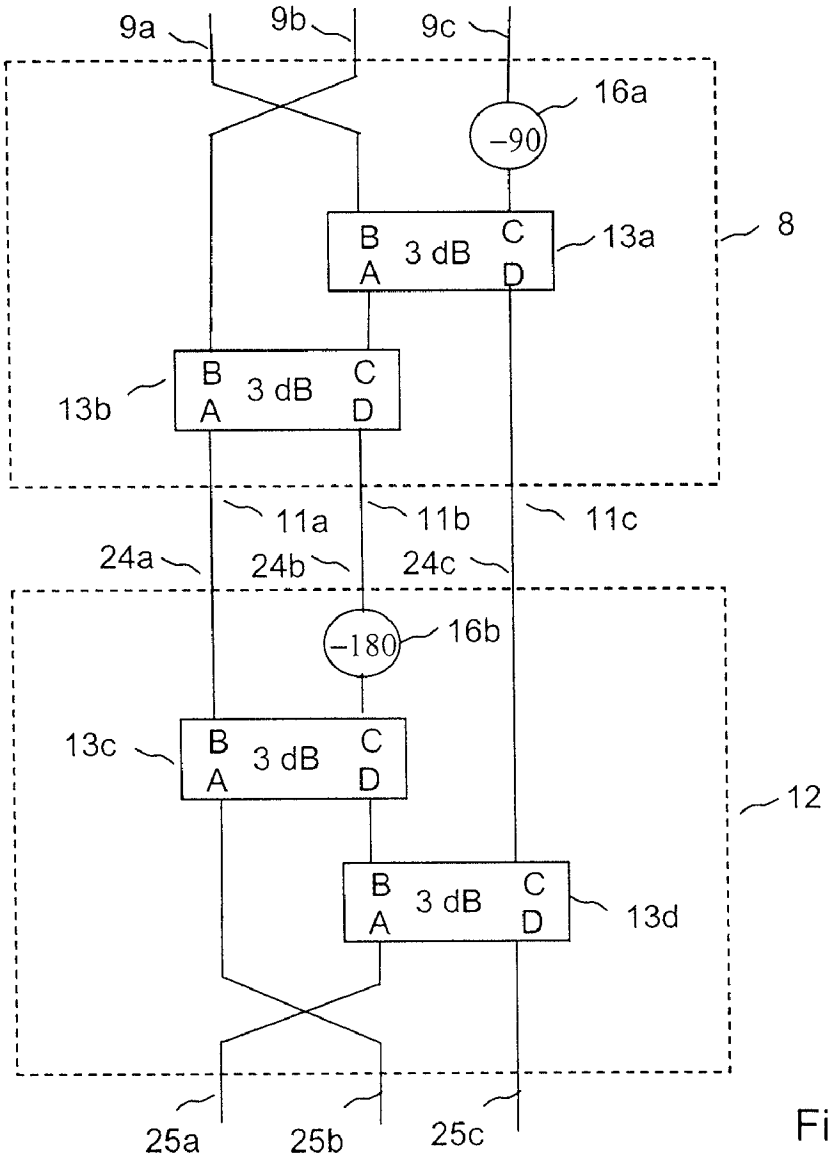
FIG. 14 is a schematic diagram showing a beamformer according to an embodiment of the present invention and an inverse beamformer according to an embodiment of the present invention.

FIG. 14 shows a beamformer 8 used in conjunction with an inverse beamformer 12. As mentioned above, when the beamformer 8 is combined with the inverse beamformer 12, signals received on antenna element ports 9*a* . . . 9*c* of the beamformer 8 are transmitted to respective individual element ports 25*a* . . . 25*c* of the inverse beamformer, while signals received on individual element ports 25*a* . . . 25*c* of the inverse beamformer are transmitted to respective antenna element ports 9*a* . . . 9*c* of the beamformer 8.

The operation of the inverse beamformer 12, having two four port couplers 13*a*, 13*b*, in conjunction with the beamformer 8 configured as described above with reference to FIG. 13 will now be described.

Signals entering the first individual element port 25*a* of the inverse beamformer 12 are connected to port A of the fourth four port coupler 13*d*. Signals leave port B of the fourth coupler 13*d* at a phase of 0 degrees and signals leave port C of the fourth coupler 13*d* at a phase of −90 degrees.

Signals from port B of the fourth coupler 13*d* are connected to port D of the third four port coupler 13*c*. Signals leave port B of the third coupler 13*c* at a phase of −90 degrees and port C at a phase of 0 degrees, which then undergo a further −180 degree phase shift in the phase shifter 16*b* so that the signals are presented to port D of the second four port coupler 13*b* at −180 degrees phase, which is equivalent to 180 degrees phase, and leave port B of the second four port coupler 13*b* at 90 degrees phase and port C of the second four port coupler 13*b* at 180 degrees phase.

Signals entering the second four port coupler 13*b* from port A leave port B at −90 degrees and leave port C of the second four port coupler 13*b* at −180 degrees, that is equivalent to 180 degrees. Accordingly, the signals at port B of the second four port coupler 13*b* arriving from ports A and D of the second four port coupler 13*b* are equal amplitude and in anti-phase and cancel; no signals are thus transmitted to the second antenna element 9*b*. However, the signals at port C of the second port coupler 13*b* arriving from ports A and D of the second coupler 13*b* are in phase and reinforce at a phase of 180 degrees.

The final signal combination occurs in the first four port coupler 13*a*; it will be appreciated that the signals arriving at port A and port D of this first four port coupler 13*a* are at the same amplitude as each other. Signals arriving at port A of the first four port coupler 13*a*, at 180 degrees, leave port B 180 degrees and leave port C at 90 degrees. Signals arriving at port D of the first four port coupler 13*a*, at −90 degrees, leave port B at 180 degrees and leave port C at −90 degrees. Accordingly, the signals at port B of the first four port coupler 13*a* arriving from ports A and D are in phase and reinforce; the signals are thus transmitted to the first antenna element 9*a*. The signals at port C of the first four port coupler 13*a* arriving from ports A and D are equal amplitude and in anti-phase and cancel, so that no signals are transmitted to the third antenna port 9*c*.

Hence it can be seen that the first, second, third and fourth couplers 13*a* . . . 13*d* are arranged such that signals transmitted into the first individual element port 25*a* of the inverse beamformer 12 are transmitted to the first antenna element port 9*a* of the beamformer 8 and not to the other antenna element ports 9*b*, 9*c*.

Similarly, signals from each of the individual element ports 25*a* . . . 25*c* arrive only at the respective antenna element ports 9*a* . . . 9*c*, while signals received at each of the antenna element ports 9*a* . . . 9*c* arrive only at the respective individual element ports 25*a* . . . 25*c*.

Figure 15:
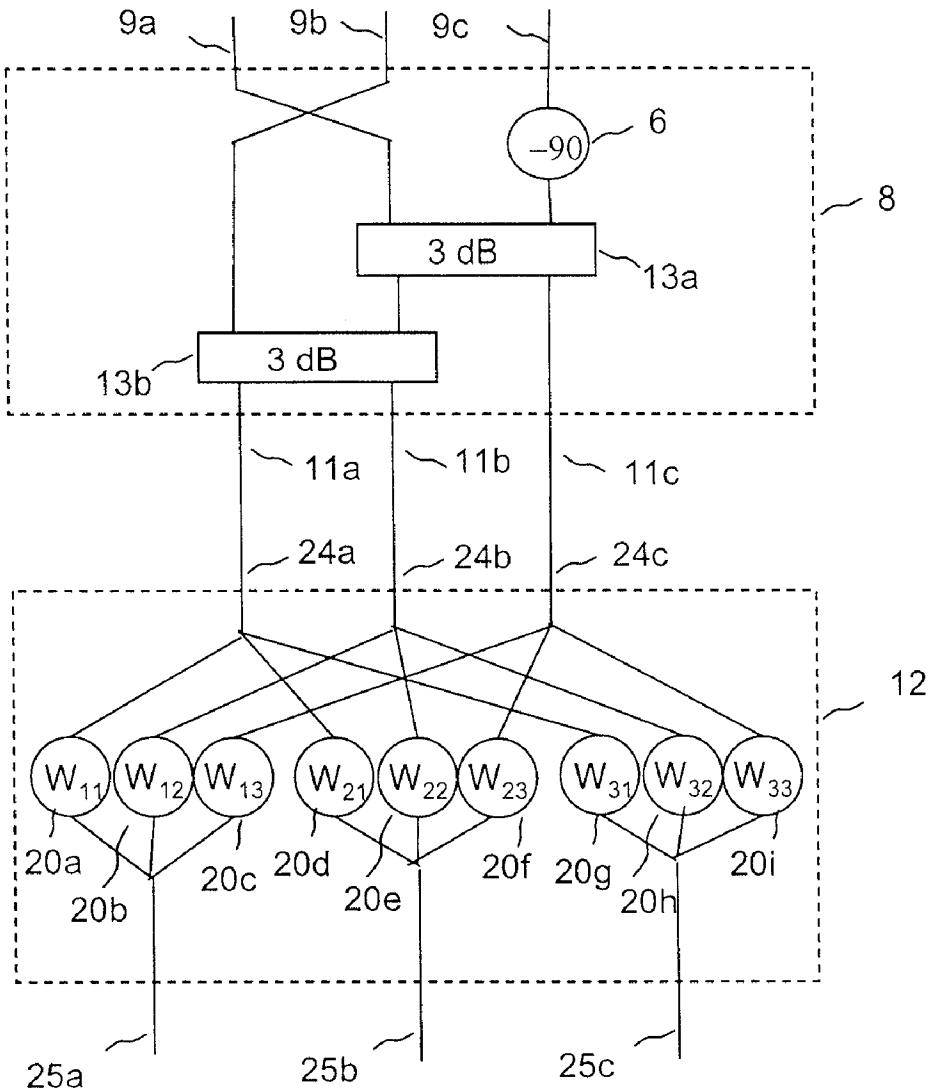
FIG. 15 is a schematic diagram showing a beamformer according to an embodiment of the present invention and an inverse beamformer according to an embodiment of the present invention implemented as an array of weighting networks.

FIG. 15 shows a beamformer 8 and an inverse beamformer 12, in which the inverse beamformer 12 is implemented by an array of weighting elements 20*a* . . . 20*i*. Each weighting element functions conventionally to weight signals in amplitude and phase, where the weighting may be typically applied in Cartesian format as Inphase and Quadrature components. The implementation of FIG. 15 can achieve the same functional result as that shown in FIG. 14 by the application of appropriate weighting element values to weighting elements 20*a* . . . 20*i*. Each individual element port 25*a* . . . 25*c* is connected to an array of weighting elements, specifically a subset of the elements 20*a* . . . 20*i*, each of which is connected to a beam port 24*a* . . . 24*c*. For example, the first individual element port 25*a* is connected to a first subset of weighting elements $W_{11}$ 20*a*, $W_{12}$ 20*b* and $W_{13}$. 20*c*. Weighting element $W_{11}$ 20*a*, is connected to the first beam port 24*a*, weighting element $W_{12}$ 20*b* is connected to the second beam port 24*b* and weighting element $W_{13}$ 20*c* is connected to the third beam port 24*c*.

The values of the weighting elements are arranged such that on receive, signals originating at the antenna element port 9*a* corresponding with the individual element port 25*a* are combined constructively at the respective individual element port 25*a*, whereas signals originating at the other antenna element ports 9*b*, 9*c* are combined destructively at the respective individual element port 25*b*, 25*c*.

On transmit, the same weighting values may be used as on receive to achieve the desired connection between an antenna element port 9*a* and a respective individual element port 25*a*.

The weighting network may be implemented via a physical device, which may be bi-directional, allowing the use of the inverse beamformer for transmit, receive, or for both. Alternatively, the weighting network may be implemented via digital signal processing components.

An example of the weighting values that could be used with the beamformer 8 design as shown in FIG. 15 is as follows. It should be noted that the amplitude values are in arbitrary units proportional to signal voltage and that the phase values in degrees are relative to other values appropriate to the individual element 25*a* . . . 25*c*. That is to say, $W_{11}$ 20*a*, $W_{12}$ 20*b* and $W_{13}$ 20*c* should have the phase values listed, relative to each other. However, the relative phase between different subsets of weighting elements is not significant. For example, the phase relationship between $W_{11}$ 20*a* and $W_{21}$ 20*d* is not significant.

| | Amplitude | Phase |
|---|---|---|
| $W_{11}$ | 0.5 | 90 |
| $W_{12}$ | 0.5 | 0 |
| $W_{13}$ | 0.707 | 90 |
| $W_{21}$ | 0.707 | 0 |
| $W_{22}$ | 0.707 | 90 |
| $W_{23}$ | Not driven | |
| $W_{31}$ | 0.5 | 180 |

-continued

| | Amplitude | Phase |
|---|---|---|
| $W_{32}$ | 0.5 | 90 |
| $W_{33}$ | 0.707 | 0 |

Figure 3:
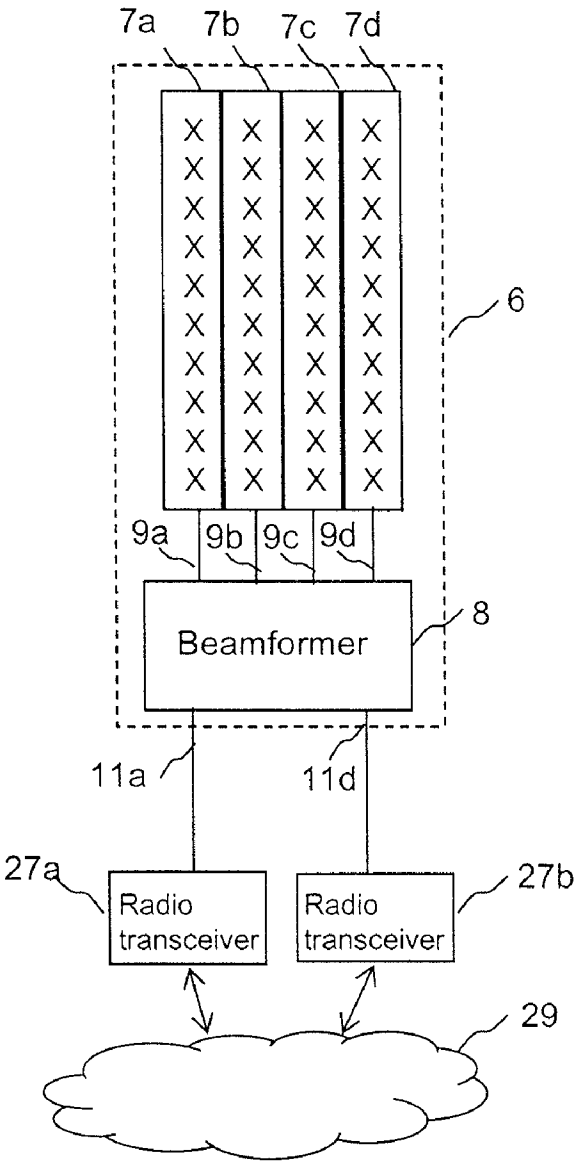
FIG. 3 is a schematic diagram showing a conventional beamforming antenna system.
Figure 16:
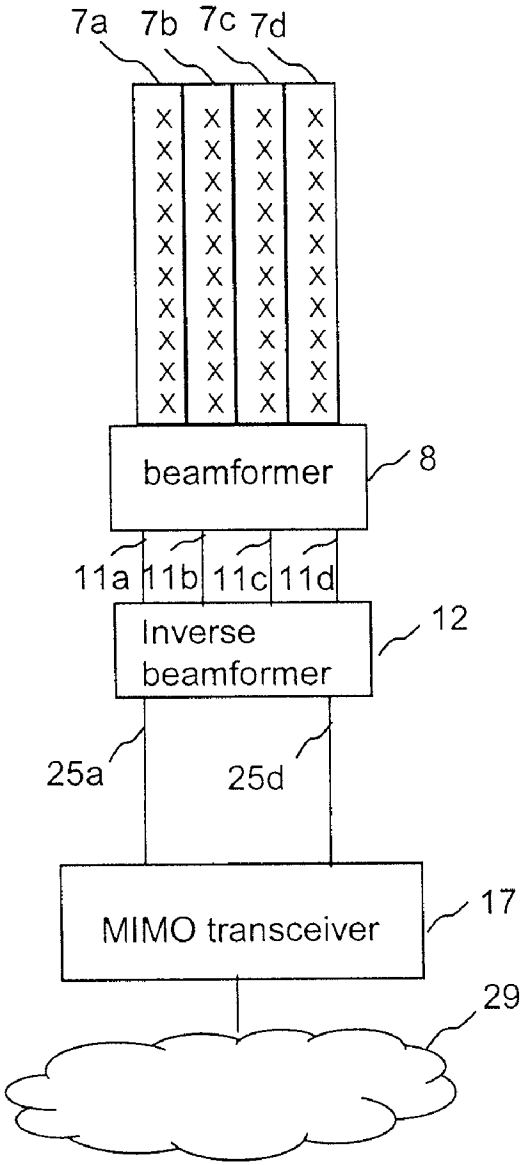
FIG. 16 is a schematic diagram showing an embodiment of the present invention comprising a four element antenna array and a MIMO transceiver.

FIG. 16 illustrates an embodiment of the invention using a four element beamformer 8 in a MIMO radio system that provides two branches per polarisation per sector. The beamformer 8 may be embodied as shown in FIG. 4. An inverse beamformer 12 is provided that is connected to the beam ports 11*a*, 11*b*, 11*c* and 11*d* of the beamformer 8. The beam ports 11*b* and 11*d* of beamformer 8 that were terminated in the system of FIG. 3 and FIG. 4 have had their terminations removed and are used to connect to the inverse beamformer. The inverse beamformer 12 receives the beams formed by the beamformer 8 and transforms them to signals that are output via individual element ports 25*a*, 25*d*, respectively corresponding to the antenna elements 7*a* and 7*d*. The two individual element ports are connected to a MIMO transceiver 17 which is itself connected to a telecommunications network 29. FIG. 16 shows the use of a single polarisation for clarity; however the system would typically employ dual polarisations as illustrated in FIG. 7 for the three element case, so that the MIMO receiver 17 would be connected to two element ports for two polarisation states giving access to 4 independent channels.

Figure 17:
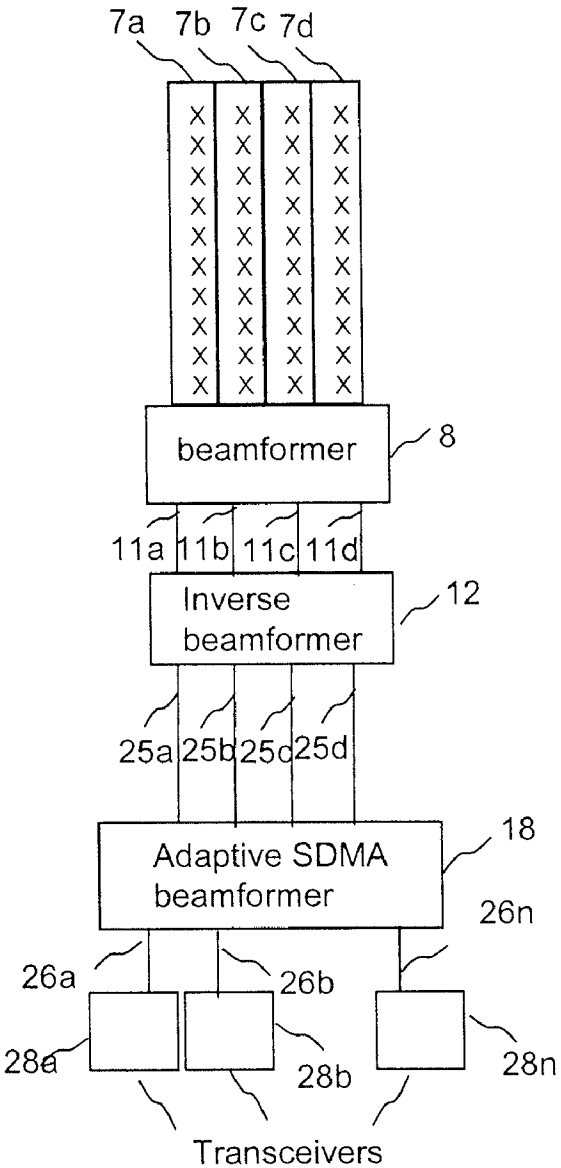
FIG. 17 is a schematic diagram showing an embodiment of the present invention comprising a four element antenna array and an adaptive SDMA beamformer.

FIG. 17 illustrates an embodiment of the invention using a four element beamformer with an adaptive SDMA beamformer, which operates in a similar manner to the three element beamformer of FIG. 8.

Figure 18:
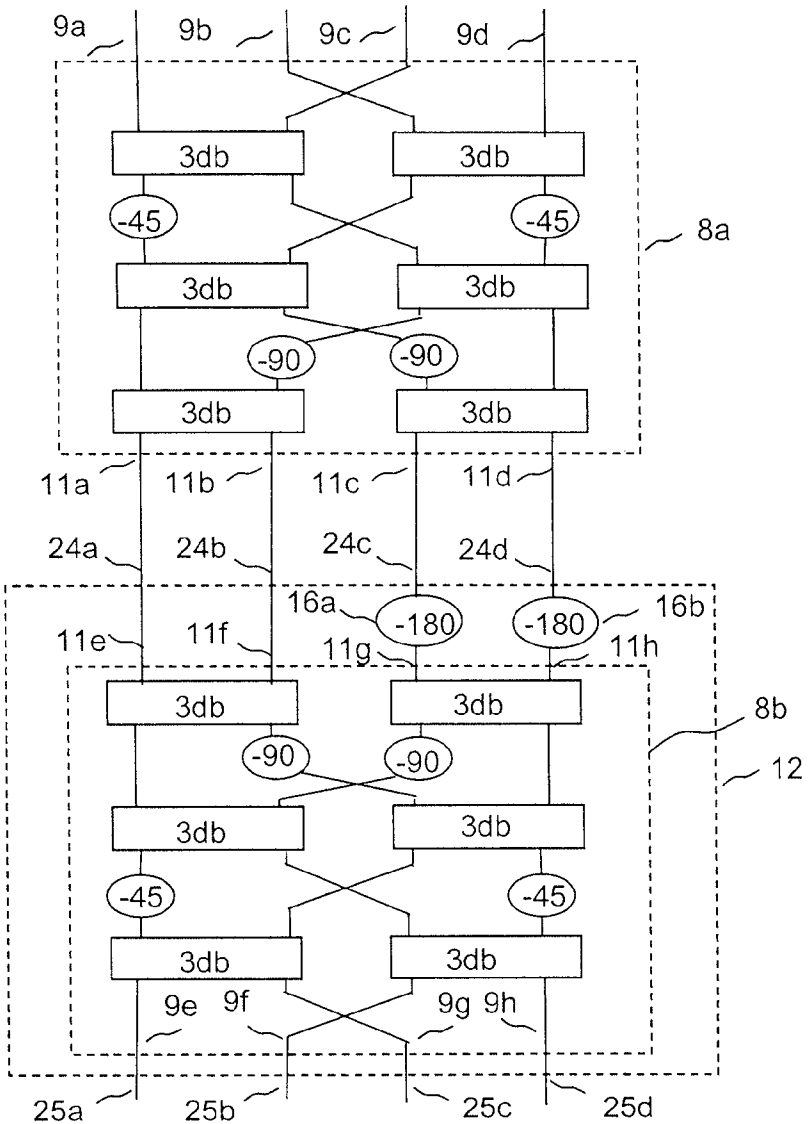
FIG. 18 is a schematic diagram showing an embodiment of the present invention comprising a four element antenna array and an inverse beamformer.

FIG. 18 shows a further embodiment of the invention, in which the inverse beamformer 12 is embodied as a second beamformer 8*b*; this second beamformer 8*b* can be embodied as the beamformer 8*a* that is connected to the antenna array 7*a* . . . 7*d*, with the addition of a −180 degree phase shifter 16*a* in series with the third beam port 11*g* and another −180 degree phase shifter 16*b* in series with the fourth beam port 11*h* of the second beamformer 8*b*. Thus, individual element ports 25*a* . . . 25*d* of the inverse beamformer 12 correspond to the respective antenna element ports 9*e* . . . 9*h* of the second beamformer 8*b*, and in the embodiment shown, the first and second beam ports 24*a* and 24*b* correspond to the first and second beam ports 11*e* and 11*f* respectively of the second beamformer 8*b*. The third and fourth beam ports 24*c* and 24*d* of the inverse beamformer 12 are connected to the phase shifters 16*a*, 16*b* that are connected to third and fourth beam ports 11*g* and 11*h* of the second beamformer 8*b* respectively.

It should be noted that a phase shift of 180 degrees has the same meaning in this context as a phase shift of −180 degrees. It should also be noted that the phase shifters could alternatively be placed in series with the first and second beam ports 11*e*, 11*f* of the second beamformer 8*b*.

Figure 19:
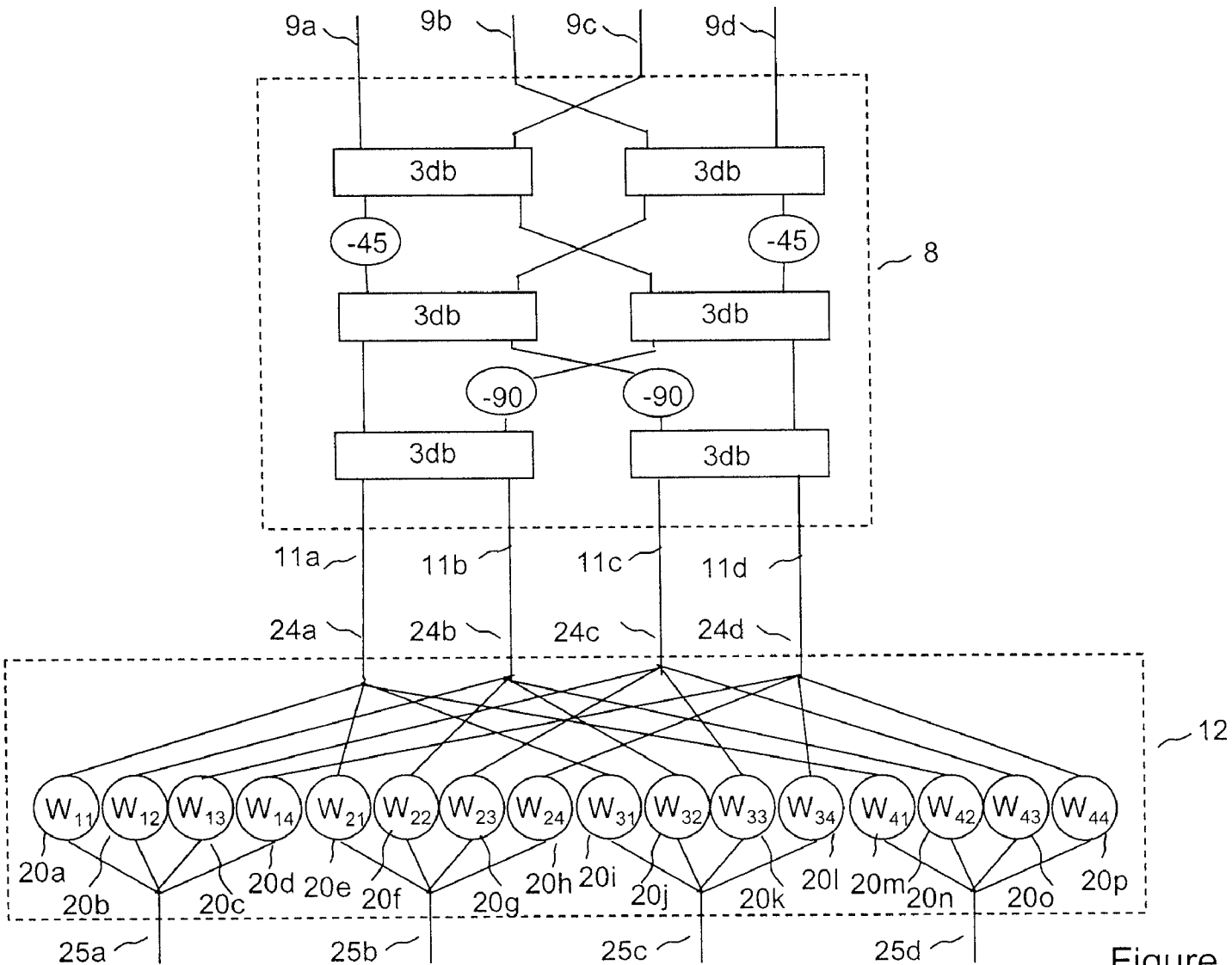
FIG. 19 is a schematic diagram showing an embodiment of the present invention comprising a four element antenna array and an inverse beamformer implemented as an array of weighting network.

FIG. 19 shows a beamformer 8 and an inverse beamformer 12, in which the inverse beamformer is implemented by an array of weighting elements 20*a* . . . 20*p* for a four antenna element arrangement; this is implemented using similar principles to the three element design described above with reference to FIG. 15.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. An inverse beamformer for connection to a beamformer of a radio transmission system, the inverse beamformer comprising:

plural beam ports for coupling to respective beam signal ports of the beamformer, the beamformer being configured to map between plural antenna element signals and plural beam signals, the antenna element signals being intended for coupling with respective antenna elements to provide plural radio beams, and the beam signals being signals intended for respective radio beams of the plural radio beams;

plural individual element signal ports for coupling plural individual element signals to transceivers; and inverse mapping circuitry configured to inverse map between the plural individual element signals and the plural beam signals so that each of the individual element signals corresponds to a respective one of the antenna element signals.

2. The inverse beamformer of claim 1, wherein the inverse mapping circuitry comprises a plurality of hybrid couplers.

3. The inverse beamformer of claim 2, wherein:

the plural beam ports comprise first, second and third beam ports;

the plural individual element signal ports comprise first, second and third individual element signal ports; and the inverse mapping circuitry comprises:

a −180 degree phase shifter connected to the second beam port;

a first four port hybrid coupler having:

a first port connected to the −180 degree phase shifter;

a second port connected to the first beam port; and a third port connected to the second individual element signal port, the third port being configured as a port having a −90 degree phase shift with respect to the first port and no phase shift with respect to the second port; and a fourth port having no phase shift with respect to the first port and a −90 degree phase shift with respect to the second port; and a second four port hybrid coupler having:

a first port connected to the third beam port;

a second port connected to the fourth port of the first four port hybrid coupler;

a third port connected to the third individual element port, the third port having no phase shift with respect to the first port; and a fourth port connected to the first individual element signal port, the fourth port having a −90 degree phase shift with respect to the first port.

4. The inverse beamformer of claim 1, wherein the inverse mapping circuitry comprises an array of weighting elements.

5. The inverse beamformer of claim 4, wherein the weighting elements are configured to weight signals in amplitude and phase.

6. The inverse beamformer of claim 4, wherein the weighting elements are implemented as at least one signal processor.

7. The inverse beamformer of claim 2, wherein:

the plural beam ports comprise first, second, third and fourth beam ports;

the plural antenna element signal ports comprise first, second, third and fourth antenna element signal ports; and the inverse mapping circuitry comprises:

a first −180 degree phase shifter connected to the third beam port;

a second −180 degree phase shifter connected to the fourth beam port;

a first four port hybrid coupler having:

a first port connected to the first beam port;

a second port connected to the second beam port; and a third port having no phase shift with respect to the first port and a −90 degree phase shift with respect to the second port; and a fourth port having no phase shift with respect to the second port and a −90 degree phase shift with respect to the first port;

a second four port hybrid coupler having:

a first port connected to the first −180 degree phase shifter;

a second port connected to the second −180 degree phase shifter;

a third port having no phase shift with respect to the first port and a −90 degree phase shift with respect to the second port; and a fourth port having no phase shift with respect to the second port and a −90 degree phase shift with respect to the first port;

a first −90 degree phase shifter connected to the fourth port of the first four port hybrid coupler;

a second −90 degree phase shifter connected to the third port of the second four port hybrid coupler;

a third four port hybrid coupler having:

a first port connected to the third port of the first four part hybrid coupler;

a second port connected to the second −90 degree phase shifter;

a third port having no phase shift with respect to the first port and a −90 degree phase shift with respect to the second port; and a fourth port having no phase shift with respect to the second port and a −90 degree phase shift with respect to the first port;

a fourth four port hybrid coupler having:

a first port connected to the first −90 degree phase shifter;

a second port connected to the fourth port of the second four port hybrid coupler;

a third port having no phase shift with respect to the first port and a −90 degree phase shift with respect to the second port; and a fourth port having no phase shift with respect to the second port and a −90 degree phase shift with respect to the first port;

a first −45 degree phase shifter connected to the third port of the third four port hybrid coupler;

a second −45 degree phase shifter connected to the fourth port of the fourth four port hybrid coupler;

a fifth four port hybrid coupler having:

a first port connected to the first −45 degree phase shifter;

a second port connected to the third port of the fourth four port hybrid coupler;

a third port connected to the first individual element signal port, the third port having no phase shift with respect to the first port and a −90 degree phase shift with respect to the second port; and a fourth port connected to the third individual element signal port, the fourth port having no phase shift with respect to the second port and a −90 degree phase shift with respect to the first port; and a sixth four port hybrid coupler having:

a first port connected to the fourth port of the third four port hybrid coupler;

a second port connected to the second −45 degree phase shifter;

a third port connected to the second individual element signal port, the third port having no phase shift with respect to the first port and a −90 degree phase shift with respect to the second port; and a fourth port connected to the fourth individual element signal port, the fourth port having no phase shift with respect to the second port and a −90 degree phase shift with respect to the first port.

8. A beamformer comprising:

plural antenna element ports, each antenna element port for coupling a respective antenna element signal to a respective antenna element of plural antenna elements;

plural beam signal ports for coupling respectively to beam signal ports of an inverse beamformer;

one or more termination ports for coupling respectively to one or more additional beam signal ports of the inverse beamformer; and mapping circuitry configured to map between the plural antenna element ports and a set of ports comprising the plural beam signal ports and the one or more termination ports.

9. The beamformer of claim 8, wherein:

the plural antenna element ports comprise first, second and third antenna element ports;

the plural beam signal ports comprise first and second beam signal ports;

the one or more termination ports comprise a single termination port; and the mapping circuitry comprises:

a −90 degree phase shifter;

a first four port hybrid coupler having:

a first port connected to the first antenna element port;

a second port connected to the −90 degree phase shifter;

a third port having no phase shift with respect to the first port and a −90 degree phase shift with respect to the second port; and a fourth port connected to the termination port, the fourth port having no phase shift with respect to the second port and a −90 degree phase shift with respect to the first port; and a second four port hybrid coupler having:

a first port connected to the second antenna element port;

a second port connected to the third port of the first four port hybrid coupler;

a third port connected to the first beam signal port, the third port having no phase shift with respect to the first port and a −90 degree phase shift with respect to the second port; and a fourth port connected to the second beam signal port, the fourth port having no phase shift with respect to the second port and a −90 degree phase shift with respect to the first port.

10. The beamformer of claim 8, wherein:

the plural antenna element ports comprise first, second, third and fourth antenna element ports;

the plural beam signal ports comprise first and second beam signal ports;

the one or more termination ports comprise first and second termination ports; and the mapping circuitry comprises:

a first four port hybrid coupler having:

a first port connected to the first antenna element port;

a second port connected to the third antenna element port;

a third port having no phase shift with respect to the first port and a −90 degree phase shift with respect to the second port; and a fourth port having no phase shift with respect to the second port and a −90 degree phase shift with respect to the first port;

a second four port hybrid coupler having:

a first port connected to the second antenna element port;

a second port connected to the fourth antenna element port;

a third port having no phase shift with respect to the first port and a −90 degree phase shift with respect to the second port; and a fourth port having no phase shift with respect to the second port and a −90 degree phase shift with respect to the first port;

a first −45 degree phase shifter connected to the third port of the first four port hybrid coupler;

a second −45 degree phase shifter connected to the fourth port of the second four port hybrid coupler;

a third four port hybrid coupler having:

a first port connected to the first −45 phase shifter;

a second port connected to the third port of the second four port hybrid coupler;

a third port having no phase shift with respect to the first port and a −90 degree phase shift with respect to the second port; and a fourth port having no phase shift with respect to the second port and a −90 degree phase shift with respect to the first port;

a fourth four port hybrid coupler having:

a first port connected to the fourth port of the first four port hybrid coupler;

a second port connected to the second −45 degree phase shifter;

a third port having no phase shift with respect to the first port and a −90 degree phase shift with respect to the second port; and a fourth port having no phase shift with respect to the second port and a −90 degree phase shift with respect to the first port;

a first −90 degree phase shifter connected to the fourth port of the third four port hybrid coupler;

a second −90 degree phase shifter connected to the third port of the fourth four port hybrid coupler;

a fifth four port hybrid coupler having:

a first port connected to the third port of the third four port hybrid coupler;

a second port connected to the second −90 degree phase shifter;

a third port connected to the first beam signal port, the third port having no phase shift with respect to the first port and a −90 degree phase shift with respect to the second port; and a fourth port connected to the first termination port, the fourth port having no phase shift with respect to the second port and a −90 degree phase shift with respect to the first port; and a sixth four port hybrid coupler having:

a first port connected to the first −90 phase shifter;

a second port connected to the fourth port of the fourth four port hybrid coupler;

a third port connected to the second termination port, the third port having no phase shift with respect to the first port and a −90 degree phase shift with respect to the second port; and a fourth port connected to the second beam signal port, the fourth port having no phase shift with respect to the second port and a −90 degree phase shift with respect to the first port.

11. A method of operating an inverse beamformer in connection with a beamformer of a radio transmission system, the method comprising:

coupling the inverse beamformer to the beamformer, the beamformer being configured to map between plural antenna element signals and plural beam signals, the antenna element signals being intended for coupling with respective antenna elements to provide plural radio beams and the beam signals being signals intended for respective ones of the plural radio beams, the inverse beamformer comprising plural beam ports, plural individual element signal ports, and inverse mapping circuitry connected between the plural beam ports and the plural individual element signal ports, wherein said coupling the inverse beamformer to the beamformer includes coupling the beam ports to respective beam signal ports of the beamformer;

coupling the plural individual element signal ports to respective transceivers, wherein plural individual element signals occur respectively at the individual element signal ports;

operating the inverse mapping circuitry to inverse map between the plural individual element signals and the plural beam signals so that the individual element signals correspond to respective ones of the antenna element signals.

12. The method of claim 11, wherein the inverse mapping circuitry comprises a plurality of hybrid couplers.

13. The method of claim 12, wherein:

the plural beam ports comprise first, second and third beam ports;

the plural individual element signal ports comprise first, second and third antenna element signal ports; and the inverse mapping circuitry comprises:

a −180 degree phase shifter connected to the second beam port;

a first four port hybrid coupler having:

a first port connected to the −180 degree phase shifter;

a second port connected to the first beam port;

a third port connected to the second individual element signal port, the third port being configured as a port having a −90 degree phase shift with respect to the first port and no phase shift with respect to the second port; and a fourth port having no phase shift with respect to the first port and a −90 degree phase shift with respect to the second port; and a second four port hybrid coupler having:

a first port connected to the third beam port;

a second port connected to the fourth port of the first four port hybrid coupler;

a third port connected to the third individual element port, the third port having no phase shift with respect to the first port; and a fourth port connected to the first individual element signal port, the fourth port having a −90 degree phase shift with respect to the first port.

14. The method of claim 11, wherein the inverse mapping circuitry comprises an array of weighting elements.

15. The method of claim 14, wherein the weighting elements are configured to weight signals in amplitude and phase.

16. The method of claim 14, wherein the weighting elements are implemented as at least one signal processor.

17. The method of claim 12, wherein:

the plural beam ports comprise first, second, third and fourth beam ports;

the plural individual element signal ports comprise first, second, third and fourth individual element signal ports; and the inverse mapping circuitry comprises:

a first −180 degree phase shifter connected to the third beam port;

a second −180 degree phase shifter connected to the fourth beam port;

a first four port hybrid coupler having:

a first port connected to the first beam port;

a second port connected to the second beam port;

a third port having no phase shift with respect to the first port and a −90 degree phase shift with respect to the second port; and a fourth port having no phase shift with respect to the second port and a −90 degree phase shift with respect to the first port;

a second four port hybrid coupler having:

a first port connected to the first −180 degree phase shifter;

a second port connected to the second −180 degree phase shifter;

a third port having no phase shift with respect to the first port and a −90 degree phase shift with respect to the second port; and a fourth port having no phase shift with respect to the second port and a −90 degree phase shift with respect to the first port;

a first −90 degree phase shifter connected to the fourth port of the first four port hybrid coupler;

a second −90 degree phase shifter connected to the third port of the second four port hybrid coupler;

a third four port hybrid coupler having:

a first port connected to the third port of the first four part hybrid coupler;

a second port connected to the second −90 degree phase shifter;

a third port having no phase shift with respect to the first port and a −90 degree phase shift with respect to the second port; and a fourth port having no phase shift with respect to the second port and a −90 degree phase shift with respect to the first port;

a fourth four port hybrid coupler having:

a first port connected to the first −90 degree phase shifter;

a second port connected to the fourth port of the second four port hybrid coupler;

a third port having no phase shift with respect to the first port and a −90 degree phase shift with respect to the second port; and a fourth port having no phase shift with respect to the second port and a −90 degree phase shift with respect to the first port;

a first −45 degree phase shifter connected to the third port of the third four port hybrid coupler;

a second −45 degree phase shifter connected to the fourth port of the fourth four port hybrid coupler;

a fifth four port hybrid coupler having:

a first port connected to the first −45 degree phase shifter;

a second port connected to the third port of the fourth four port hybrid coupler;

a third port connected to the first individual element signal port, the third port having no phase shift with respect to the first port and a −90 degree phase shift with respect to the second port; and a fourth port connected to the third individual element signal port, the fourth port having no phase shift with respect to the second port and a −90 degree phase shift with respect to the first port; and a sixth four port hybrid coupler having:

a first port connected to the fourth port of the third four port hybrid coupler;

a second port connected to the second −45 degree phase shifter;

a third port connected to the second individual element signal port, the third port having no phase shift with respect to the first port and a −90 degree phase shift with respect to the second port; and a fourth port connected to the fourth individual element signal port, the fourth port having no phase shift with respect to the second port and a −90 degree phase shift with respect to the first port.

18. A method of operating a beamformer, the beamformer comprising plural antenna element ports, plural beam signal ports, one or more termination ports, and mapping circuitry connected between the beam signal ports and the one or more termination ports and the antenna element ports, the method comprising:

coupling the antenna element ports to respective antenna elements;

coupling the beam signal ports respectively to beam signal ports of an inverse beamformer;

coupling the one or more termination ports respectively to one or more additional beam signal ports of the inverse beamformer; and operating the mapping circuitry to map between the plural antenna element ports and a set of ports comprising the plural beam signal sorts and the one or more termination ports.

19. The method of claim 18, wherein:

the plural antenna element ports comprise first, second and third antenna element ports;

the plural beam signal ports comprise first and second beam signal ports;

the one or more termination ports comprise a single termination port; and the mapping circuitry comprises:

a −90 degree phase shifter;

a first four port hybrid coupler having:

a first port connected to the first antenna element port;

a second port connected to the −90 degree phase shifter;

a third port having no phase shift with respect to the first port and a −90 degree phase shift with respect to the second port; and a fourth port connected to the termination port, the fourth port having no phase shift with respect to the second port and a −90 degree phase shift with respect to the first port; and a second four port hybrid coupler having:

a first port connected to the second antenna element port;

a second port connected to the third port of the first four port hybrid coupler;

a third port connected to the first beam signal port, the third port having no phase shift with respect to the first port and a −90 degree phase shift with respect to the second port; and a fourth port connected to the second beam signal port, the fourth port having no phase shift with respect to the second port and a −90 degree phase shift with respect to the first port.

20. The method of claim 18, wherein:

the plural antenna element ports comprise first, second, third and fourth antenna element ports;

the plural beam signal ports comprise first and second beam signal ports;

the one or more termination ports comprise first and second termination ports; and the mapping circuitry comprises:

a first four port hybrid coupler having:

a first port connected to the first antenna element port;

a second port connected to the third antenna element port;

a third port having no phase shift with respect to the first port and a −90 degree phase shift with respect to the second port; and a fourth port having no phase shift with respect to the second port and a −90 degree phase shift with respect to the first port;

a second four port hybrid coupler having:

a first port connected to the second antenna element port;

a second port connected to the fourth antenna element port;

a third port having no phase shift with respect to the first port and a −90 degree phase shift with respect to the second port; and a fourth port having no phase shift with respect to the second port and a −90 degree phase shift with respect to the first port;

a first −45 degree phase shifter connected to the third port of the first four port hybrid coupler;

a second −45 degree phase shifter connected to the fourth port of the second four port hybrid coupler;

a third four port hybrid coupler having:

a first port connected to the first −45 phase shifter;

a second port connected to the third port of the second four port hybrid coupler;

a third port having no phase shift with respect to the first port and a −90 degree phase shift with respect to the second port; and a fourth port having no phase shift with respect to the second port and a −90 degree phase shift with respect to the first port;

a fourth four port hybrid coupler having:

a first port connected to the fourth port of the first four port hybrid coupler;

a second port connected to the second −45 degree phase shifter;

a third port having no phase shift with respect to the first port and a −90 degree phase shift with respect to the second port; and a fourth port having no phase shift with respect to the second port and a −90 degree phase shift with respect to the first port;

a first −90 degree phase shifter connected to the fourth port of the third four port hybrid coupler;

a second −90 degree phase shifter connected to the third port of the fourth four port hybrid coupler;

a fifth four port hybrid coupler having:

a first port connected to the third port of the third four port hybrid coupler;

a second port connected to the second −90 degree phase shifter;

a third port connected to the first beam signal port, the third port having no phase shift with respect to the first port and a −90 degree phase shift with respect to the second port; and a fourth port connected to the first termination port, the fourth port having no phase shift with respect to the second port and a −90 degree phase shift with respect to the first port; and a sixth four port hybrid coupler having:

a first port connected to the first −90 phase shifter;

a second port connected to the fourth port of the fourth four port hybrid coupler;

a third port connected to the second termination port, the third port having no phase shift with respect to the first port and a −90 degree phase shift with respect to the second port; and a fourth port connected to the second beam signal port, the fourth port having no phase shift with respect to the second port and a −90 degree phase shift with respect to the first port.

21. A beamformer for coupling between at least one transceiver and plural antenna elements, the beamformer comprising:

plural antenna element ports, each antenna element port for coupling a respective antenna element signal to a respective antenna element of the plural antenna elements;

plural beam signal ports for coupling to the at least one transceiver;

one or more termination ports, wherein at least one of the one or more termination ports is configured for coupling to a removable external termination; and mapping circuitry configured to map between the plural antenna element ports and a set of ports comprising the plural beam signal ports and the one or more termination ports.

22. The beamformer of claim 21, wherein:

the plural antenna element ports comprise first, second and third antenna element ports;

the plural beam signal ports comprise first and second beam signal ports;

the one or more termination ports comprise a single termination port; and the mapping circuitry comprises:

a −90 degree phase shifter;

a first four port hybrid coupler having:

a first port connected to the first antenna element port;

a second port connected to the −90 degree phase shifter;

a third port having no phase shift with respect to the first port and a −90 degree phase shift with respect to the second port; and a fourth port connected to the termination port, the fourth port having no phase shift with respect to the second port and a −90 degree phase shift with respect to the first port; and a second four port hybrid coupler having:

a first port connected to the second antenna element port;

a second port connected to the third port of the first four port hybrid coupler;

a third port connected to the first beam signal port, the third port having no phase shift with respect to the first port and a −90 degree phase shift with respect to the second port; and a fourth port connected to the second beam signal port, the fourth port having no phase shift with respect to the second port and a −90 degree phase shift with respect to the first port.

23. The beamformer of claim 21, wherein:

the plural antenna element ports comprise first, second, third and fourth antenna element ports;

the plural beam signal ports comprise first and second beam signal ports;

the one or more termination ports comprise first and second termination ports; and the mapping circuitry comprises:

a first four port hybrid coupler having:

a first port connected to the first antenna element port;

a second port connected to the third antenna element port;

a third port having no phase shift with respect to the first port and a −90 degree phase shift with respect to the second port; and a fourth port having no phase shift with respect to the second port and a −90 degree phase shift with respect to the first port;

a second four port hybrid coupler having:

a first port connected to the second antenna element port;

a second port connected to the fourth antenna element port;

a third port having no phase shift with respect to the first port and a −90 degree phase shift with respect to the second port; and a fourth port having no phase shift with respect to the second port and a −90 degree phase shift with respect to the first port;

a first −45 degree phase shifter connected to the third port of the first four port hybrid coupler;

a second −45 degree phase shifter connected to the fourth port of the second four port hybrid coupler;

a third four port hybrid coupler having:

a first port connected to the first −45 phase shifter;

a second port connected to the third port of the second four port hybrid coupler;

a third port having no phase shift with respect to the first port and a −90 degree phase shift with respect to the second port; and a fourth port having no phase shift with respect to the second port and a −90 degree phase shift with respect to the first port;

a fourth four port hybrid coupler having:

a first port connected to the fourth port of the first four port hybrid coupler;

a second port connected to the second −45 degree phase shifter;

a third port having no phase shift with respect to the first port and a −90 degree phase shift with respect to the second port; and a fourth port having no phase shift with respect to the second port and a −90 degree phase shift with respect to the first port;

a first −90 degree phase shifter connected to the fourth port of the third four port hybrid coupler;

a second −90 degree phase shifter connected to the third port of the fourth four port hybrid coupler;

a fifth four port hybrid coupler having:

a first port connected to the third port of the third four port hybrid coupler;

a second port connected to the second −90 degree phase shifter;

a third port connected to the first beam signal port, the third port having no phase shift with respect to the first port and a −90 degree phase shift with respect to the second port; and a fourth port connected to the first termination port, the fourth port having no phase shift with respect to the second port and a −90 degree phase shift with respect to the first port; and a sixth four port hybrid coupler having:

a first port connected to the first −90 phase shifter;

a second port connected to the fourth port of the fourth four port hybrid coupler;

a third port connected to the second termination port, the third port having no phase shift with respect to the first port and a −90 degree phase shift with respect to the second port; and a fourth port connected to the second beam signal port, the fourth port having no phase shift with respect to the second port and a −90 degree phase shift with respect to the first port.

24. The beamformer of claim 21, wherein the beamformer is integrated with the plural antenna elements.

25. A method of operating a beamformer, the beamformer comprising plural antenna element ports, plural beam signal ports, one or more termination ports, and mapping circuitry connected between the beam signal ports and the one or more termination ports and the antenna element ports, the method comprising:

coupling the antenna element ports to respective antenna elements;

coupling the beam signal ports to the at least one transceiver;

coupling at least one of the one or more termination ports to a removable external termination; and operating the mapping circuitry to map between the plural antenna element ports and a set of ports comprising the plural beam signal ports and the one or more termination ports.

26. The method of claim 25, wherein:

the plural antenna element ports comprise first, second and third antenna element ports;

the plural beam signal ports comprise first and second beam signal ports;

the one or more termination ports comprise a single termination port; and the mapping circuitry comprises:

a −90 degree phase shifter;

a first four port hybrid coupler having:

a first port connected to the first antenna element port;

a second port connected to the −90 degree phase shifter;

a third port having no phase shift with respect to the first port and a −90 degree phase shift with respect to the second port; and a fourth port connected to the termination port, the fourth port having no phase shift with respect to the second port and a −90 degree phase shift with respect to the first port; and a second four port hybrid coupler having:

a first port connected to the second antenna element port;

a second port connected to the third port of the first four port hybrid coupler;

a third port connected to the first beam signal port, the third port having no phase shift with respect to the first port and a −90 degree phase shift with respect to the second port; and a fourth port connected to the second beam signal port, the fourth port having no phase shift with respect to the second port and a −90 degree phase shift with respect to the first port.

27. The method of claim 25, wherein:

the plural antenna element ports comprise first, second, third and fourth antenna element ports;

the plural beam signal ports comprise first and second beam signal ports;

the one or more termination ports comprise first and second termination ports; and the mapping circuitry comprises:

a first four port hybrid coupler having:

a first port connected to the first antenna element port;

a second port connected to the third antenna element port;

a third port having no phase shift with respect to the first port and a −90 degree phase shift with respect to the second port; and a fourth port having no phase shift with respect to the second port and a −90 degree phase shift with respect to the first port;

a second four port hybrid coupler having:

a first port connected to the second antenna element port;

a second port connected to the fourth antenna element port;

a third port having no phase shift with respect to the first port and a −90 degree phase shift with respect to the second port; and a fourth port having no phase shift with respect to the second port and a −90 degree phase shift with respect to the first port;

a first −45 degree phase shifter connected to the third port of the first four port hybrid coupler;

a second −45 degree phase shifter connected to the fourth port of the second four port hybrid coupler;

a third four port hybrid coupler having:

a first port connected to the first −45 phase shifter;

a second port connected to the third port of the second four port hybrid coupler;

a third port having no phase shift with respect to the first port and a −90 degree phase shift with respect to the second port; and a fourth port having no phase shift with respect to the second port and a −90 degree phase shift with respect to the first port;

a fourth four port hybrid coupler having:

a first port connected to the fourth port of the first four port hybrid coupler;

a second port connected to the second −45 degree phase shifter;

a third port having no phase shift with respect to the first port and a −90 degree phase shift with respect to the second port; and a fourth port having no phase shift with respect to the second port and a −90 degree phase shift with respect to the first port;

a first −90 degree phase shifter connected to the fourth port of the third four port hybrid coupler;

a second −90 degree phase shifter connected to the third port of the fourth four port hybrid coupler;

a fifth four port hybrid coupler having:

a first port connected to the third port of the third four port hybrid coupler;

a second port connected to the second −90 degree phase shifter;

a third port connected to the first beam signal port, the third port having no phase shift with respect to the first port and a −90 degree phase shift with respect to the second port; and a fourth port connected to the first termination port, the fourth port having no phase shift with respect to the second port and a −90 degree phase shift with respect to the first port; and a sixth four port hybrid coupler having:

a first port connected to the first −90 phase shifter;

a second port connected to the fourth port of the fourth four port hybrid coupler;

a third port connected to the second termination port, the third port having no phase shift with respect to the first port and a −90 degree phase shift with respect to the second port; and a fourth port connected to the second beam signal port, the fourth port having no phase shift with respect to the second port and a −90 degree phase shift with respect to the first port.

28. The beamformer of claim 8, wherein the beamformer is integrated with the antenna elements.

* * * * *